US006213873B1

(12) United States Patent
Gasper et al.

(10) Patent No.: US 6,213,873 B1
(45) Date of Patent: Apr. 10, 2001

(54) USER-ADAPTABLE COMPUTER CHESS SYSTEM

(75) Inventors: Elon J. Gasper, Bellevue; Thomas M. Abbott, Issaquah; John G. Gilmore, Seattle, all of WA (US)

(73) Assignee: Sierra-On-Line, Inc., Bellevue, WA (US)

( * ) Notice: Subject to any disclaimer, the term of this patent is extended or adjusted under 35 U.S.C. 154(b) by 0 days.

(21) Appl. No.: 09/073,409

(22) Filed: May 5, 1998

Related U.S. Application Data

(60) Provisional application No. 60/046,772, filed on May 9, 1997.

(51) Int. Cl.[7] ..... A63F 3/00

(52) U.S. Cl. ..... 463/14; 463/23; 463/42; 434/128; 395/173

(58) Field of Search ..... 463/14, 27, 9, 463/42; 434/128; 273/236, 260, 237, 261; 395/173

(56) References Cited

U.S. PATENT DOCUMENTS 2,592,897 * 4/1952 Heinoo .
4,156,976 * 6/1979 Mikun .
4,285,517 * 8/1981 Morrison .
4,366,960 * 1/1983 Bromley et al. .
4,398,720 * 8/1983 Jones et al. .
4,716,529 * 12/1987 Nakayama .
5,035,625 * 7/1991 Munson et al. .
5,098,106 * 3/1992 Hegner .
5,678,001 * 10/1997 Nagel et al. .
5,779,549 * 7/1998 Walker et al. ..... 463/42
5,971,850 * 10/1999 Liverance .

OTHER PUBLICATIONS

Voice Chess Challenger, New Yorker, vol. LV, No. 37, Oct. 29, 1979, p1.*

Katz and Butler, "Game Commander"—applying an architecture of game theory and tree lookahead to the command and control process, IEEE, all pages, Jan. 1994.*

* cited by examiner

*Primary Examiner*—Mark Sager
*Assistant Examiner*—John M. Hotaling, II
(74) *Attorney, Agent, or Firm*—Lariviere, Grubman & Payne, LLP

(57) ABSTRACT

A computer-based strategic game system for, e.g., playing chess includes a kingbrain that is characterized by a rating and a queen brain. The rating of the kingbrain is automatically adjusted to the skill of the player, as determined by the queen brain, such that the kingbrain generates opponent moves to counter the player's moves with an effectiveness that is marginally above the player's ability. When the player is losing, the kingbrain can assume an aggressive heroic style of play. On the other hand, when the player is winning, the kingbrain can assume a defensive craven style of play. As the game unfolds, the queen brain evaluates each of the player's moves, and audio-visual annotations and game commentary based on the queen brain's evaluations are spooled to disk. At the end of the game, the annotations and commentary are immediately available to the player for instruction. A variation tree can also be generated that shows in graphical form the player's moves and the kingbrain's moves, and the player can manipulate the tree to explore the outcomes of alternate moves that the player might have made.

26 Claims, 12 Drawing Sheets

USER-ADAPTABLE COMPUTER CHESS SYSTEM

CROSS-REFERENCE TO RELATED APPLICATIONS

This application claims priority from U.S. provisional patent application Ser. No. 60/046,772, filed May 9, 1997, incorporated herein by reference.

REGARDING FEDERALLY SPONSORED RESEARCH OR DEVELOPMENT

Not Applicable

REFERENCE TO A MICROFICHE APPENDIX

This application includes a microfiche appendix of a software listing, the copyright to which is retained by the copyright owner. The copyright owner has no objection to the reproduction of the patent document or the patent disclosure as it appears on the files and records of the U.S. Patent and Trademark Office, but otherwise reserves all copyright rights whatsoever.

TECHNICAL FIELD

The present invention relates generally to computer-based games of strategy, and more particularly to computer chess games.

BACKGROUND ART

Strategic games, such as chess, checkers, Nim, and Go, have been popular for centuries, and these strategic games continue to be popular forms of creative recreation. Accordingly, it is perhaps not surprising that with the advent of computers, computer-based chess engines have been developed against which a player can match wits. Owing to the extraordinary complexity of strategic games such as chess that stem from the enormous number of move combinations which are possible over the course of the game, chess engines require comparatively fast processors. As processor technology has advanced, so have chess engines.

It happens that chess players who might want to play computer chess range from novice to grandmaster. Stated differently, the consumer of a computer chess product might have a very low chess rating, indicating that the consumer has little or no skill at chess, while another consumer might have a very high chess rating, indicating that the consumer has a great deal of skill at chess. Regardless, the present invention recognizes that it is desirable to provide a computer chess game that is entertaining and challenging for virtually all consumers who might want to match wits against a computer.

Representative of current advanced computer-based chess engines is IBM's "Deep Blue" system. The "Deep Blue" system, like other chess engines such as the WChess engine developed by Heuristic Programming Inc. of Mobile, Ala., has been developed to the point where the equivalent chess ratings of the engine is as high as the ratings of human grandmasters. It readily will be appreciated that current chess engines that can defeat grandmasters will overwhelm ordinary chess players.

To render such advanced chess engines appropriate for use by an ordinary chess player while retaining the ability of the engine to defeat advanced players, systems have been provided that permit a user-player to define the desired skill level, i.e., the rating, of his or her computer opponent, that is, the chess engine. In response to the user's definition, the system disables, i.e., cripples, the chess engine by an amount that will cause the engine to generate moves at the user-defined skill level.

As recognized by the present invention, however, such systems have drawbacks, including the drawback of discouraging a player who wins and believes the victory to be the result of setting the computer's rating too low. Or, a player might set the computer's rating too high, thereby ensuring that the player will rarely if ever win and, thus, dampening the player's enthusiasm for the game. As recognized by the present invention, it would be advantageous for a computer chess brain to automatically adapt to the actual playing skill of a player as evidenced by the player's move, to permit the player to win about 25% of the time. With this win ratio, the player is assured of continuously learning and improving at chess without becoming unduly discouraged at repeated losses.

Accordingly, it is an object of the present invention to provide a strategic game program which automatically adapts to a player's skill level. Another object of the present invention is to provide a computer chess game which is entertaining and educational. Still another object of the present invention is to provide a computer chess game that is easy to use and cost effective.

Other features of the present invention are disclosed or apparent in the section entitled: "BEST MODE FOR CARRYING OUT THE INVENTION."

DISCLOSURE OF INVENTION

The present invention is a computer chess game system that automatically adapts its apparent skill to each human opponent it plays, based on the human opponent's moves. During the game, the present system evaluates each move of the human opponent for updating the system's adaption to that opponent and for generating an audio-visual critique of the human opponent's play immediately post game, to maximize both the entertainment and instructional utility of the system.

The chess game provided by the present system includes three main phases (under most circumstances) that a human, referred to herein as a "player", contests against an adaptive computer opponent, referred to herein as the "King" or "Kingbrain". The "King" or "Kingbrain" is an instantiation of a commercial chess engine, preferably the WChess™ engine discussed above, that is adaptively "crippled" as appropriate for the player's skill as demonstrated by the player's moves.

The first of the three main phases is the opening book, in which the King's moves follow a predetermined plan unless and until the player deviates from what the plan considers to be the optimum or near-optimum player moves in the opening book. The predetermined plan includes various "traps", i.e., preprogrammed mistakes that the King will make. Once a player refutes a particular mistake (by taking advantage of the mistake by making one or more preprogrammed "correct" moves), the King will not make the mistake again in subsequent games. Rather, in subsequent games the King will play the "correct" move in the opening book and proceed to subsequent moves (and traps).

Once the player has deviated from the preprogrammed opening book moves, the game enters a "midgame" phase which chessically can include midgame and endgame positions. In the midgame phase, the King's moves in response to those of the player are no longer rendered by a preprogrammed plan. Rather, the King's moves are rendered by the Kingbrain chess engine, i.e., the WChess™ engine as crippled to adapt to the player's ability as evidenced by the player's moves in previous games. Thus, the strength rating of the Kingbrain is established in response to the player moves in previous games.

Furthermore, the playing style and strength rating of the Kingbrain dynamically can change within a game, in response to what the Kingbrain perceives to be the game situation. Specifically, if the Kingbrain assesses that it is winning, it can assume a "heroic" style of play in which the King makes aggressive moves. As part of the "heroic" style, the Kingbrain may not be permitted to think as long as it would otherwise, thus affecting the strength of the Kingbrain. Also, if the Kingbrain assesses that it is losing, it can assume a "craven" style of play in which the King makes conservative, defensive moves. Moreover, after assuming the heroic style and then losing ground as a result, the Kingbrain can revert only to a craven style, and then only after it is losing significantly. Likewise, after assuming the "craven" style, the Kingbrain will not revert to a normal style of play until it is winning significantly. This is referred to herein as "hysterisis". Both the conditions for assuming the various styles of play, and the hysterisis, are determined by the Kingbrain strength rating.

When the midgame concludes as determined by, among other things, the number of pieces left on the board, the game enters the endgame. The King's moves during the endgame are affected both by the Kingbrain rating and the King's style of play.

During the midgame, a second instantiation of the chess engine is rendered and is referred to herein as the "Queen" or "Queen brain". The Queen brain instantiation is the uncrippled chess engine. During the midgame, the Queen brain evaluates both the King's moves and the player's moves by comparing the moves to what the uncrippled chess engine determines are hypothetically the optimum moves for the particular situation. The Queen brain assessment is translated to a running commentary which is played back to the player in audio-visual format immediately following the game on a move-by-move basis, thereby establishing a highly effective learning tool and teaching aid from which the player can gain valuable insight. Also, the Queen brain assessments of the player's moves are used to modify the Kingbrain strength rating for the next game. The adaptive and instructional principles disclosed herein can be applied to other strategic games such as Go, Nim, checkers, etc.

In particular aspects of the present invention, a computer chess game system includes computer readable code means for accessing a chess engine kingbrain to generate opponent signals representative of opponent chess moves. In accordance with the present invention, the kingbrain is characterized by a kingbrain rating. Computer readable code means receive one or more player inputs representative of respective player moves, with computer readable code means then establishing a kingbrain rating in response to one or more of the player moves.

Under some circumstances, the kingbrain rating is established by establishing a processing time per move for the kingbrain. Under other circumstances, the kingbrain rating is established by establishing a level of search and a degree of evaluation randomness for the kingbrain. In any case, the player can play a sequence of games using the system, and the kingbrain rating is based at least in part on a kingbrain strength that is established based on at least one game in the sequence of games.

In a particularly preferred embodiment, a chess engine queen brain is provided, with the queen brain being an uncrippled instantiation of the chess engine. The kingbrain can be characterized by at least a heroic style characterized by comparatively high aggressiveness and a craven style characterized by comparatively high defensiveness. Computer readable code means cause the kingbrain to assume the heroic style when at least one of: the kingbrain and queen brain, determines that the player is losing, and to assume the craven style when at least one of: the kingbrain and queen brain, determines that the player is winning.

Still further, computer readable code means can be associated with the queen brain for comparing at least some player moves to hypothetical moves when the respective player signals are generated to generate a game analysis. Computer readable code means then generate an audible representation of the analysis. Also, computer readable code means can be provided for generating a variation tree display. The variation tree display includes a graphical tree including lines representing the player moves and opponent moves for a game, and it also contains textual annotations regarding the moves as generated by the queen brain.

In another aspect, an interactive game system includes a computer-implemented opponent brain, and means for receiving player signals from a player, with the player signals being representative of player moves. Also, means are responsive to the player signals for selectively establishing an expertise with which the opponent brain counters the player moves in at least subsequent games.

In still another aspect, a computer-implemented method for playing chess is disclosed. The method includes providing a kingbrain for generating opponent moves. Per the present method, the kingbrain is characterized by a kingbrain rating representative of an expertise with which the kingbrain generates the opponent moves. The method also includes receiving player signals representative of player moves, and establishing a kingbrain rating based on at least one of: at least one player move, and a sequence of player moves.

In yet another aspect, an interactive computer game system includes at least one engine brain and computer readable code means for receiving player signals representative of player moves. Further, the game system includes computer readable code means associated with the engine brain for comparing at least some player moves to hypothetical moves when the respective player signals are generated to generate a game analysis. Then, computer readable code means generate an audio-visual representation of the analysis.

In another aspect, a computer chess game system includes a chess engine kingbrain characterized by at least a heroic style characterized by comparatively high aggressiveness and a craven style characterized by comparatively high defensiveness. Player signals are received that are representative of player moves. Code means then cause the kingbrain to assume the heroic style when the kingbrain determines that the player is losing based at least in part on the player moves. Code means also cause the kingbrain to assume the craven style when the kingbrain determines that the player is winning based at least in part on the player moves.

In still another aspect, a computer-based strategic game system includes means for receiving player signals representative of player moves, and means for generating opponent moves in response to the player moves. The system further includes means for analyzing the player moves, and means for generating a variation tree. The variation tree includes a graphical tree that in turn includes lines representing the player moves and opponent moves for a game.

BRIEF DESCRIPTION OF DRAWINGS

For fuller understanding of the present invention, reference is made to the accompanying drawing in the following detailed description of the Best Mode of Carrying Out the Present Invention. In the drawings.

BEST MODE FOR CARRYING OUT THE INVENTION

Figure 1:
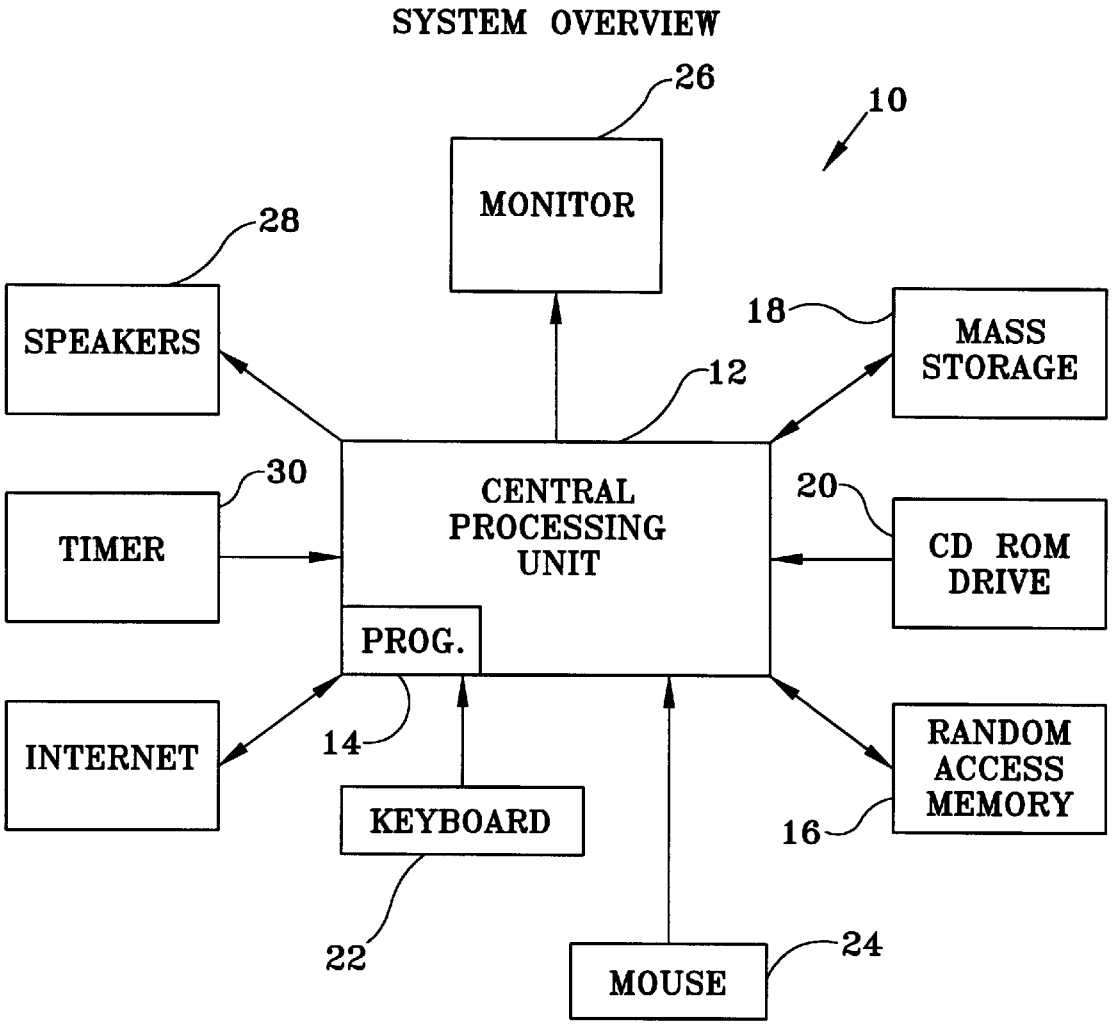
FIG. 1 is a block diagram of the physical components of the present system.

Referring initially to FIG. 1, a system is shown, generally designated 10, for playing computerized chess or other strategic game. For clarity of disclosure, the discussion herein focusses on chess. As shown in FIG. 1, the system 10 includes a digital central processing unit (CPU) 12 and an associated program storage device 14. In the presently preferred embodiment, the CPU 12 is a computer that includes a processor made by Intel Corp. or Advanced Micro Devices Corp. as might be embodied in, e.g., an IBM-compatible personal computer or laptop computer, although other types of computers, e.g., a computer made by Apple Computer or a type HP 9000/755 computer made by Hewlett-Packard and running the Unix-based operating system known as HP-UX 9.05, may be used.

In accordance with the present invention, the program storage device 14 may be implemented by one or more processors within the CPU 12 that execute a series of computer-executable instructions. The program storage device 14 may be implemented, for example, by electronic random access memory (RAM) 16 and/or electronic read-only memory (ROM) of the CPU 12. Alternatively, the instructions may physically be contained on a data storage medium, such as a computer diskette, that embodies a machine component as a combination of program code elements in computer readable form that are stored on a computer-usable data medium on the computer diskette. Or, such media can also be found in semiconductor devices, or on a mass storage medium 18 such as magnetic tape or hard disk drive, or on optical disks that can be engaged with a CD-ROM drive 20, or other appropriate data storage device.

Thus, the flow charts and block diagrams disclosed herein illustrate the structure of the computer chess game system the present invention as embodied in computer program software. Those skilled in the art will appreciate that the Figures illustrate the structures of computer program code elements that function according to this invention. Manifestly, the invention is practiced in one essential embodiment by a machine component that renders the computer program code elements in a form that instructs a digital processing apparatus (that is, a computer) to perform a sequence of operational steps corresponding to those shown in the Figures. In an illustrative embodiment of the invention, the computer-executable instructions may be lines of compiled "ROYOL" code, which is a scripting language and which is disclosed in the accompanying microfiche appendix, or compiled lines of any other appropriate language code such as assembly code.

In any case, whether embodied by software on a diskette or other medium or embodied by logic circuits resident on a semiconductor chip that is accessible to a microprocessor, the present computer usable medium includes logic means for undertaking the inventive steps disclosed herein. As yet another alternative, the present invention can be implemented by a circuit board (not shown).

FIG. 1 shows that the system 10 can include one or more data input devices, such as a keyboard 22 and mouse 24. Other well-known input device configurations can be used, e.g., a keypad, trackball, or voice-recognition device. Or, a 3D input device can be used. Also, the system 10 includes one or more output devices, such as a video monitor 26 and audio speakers 28. It is to be understood that the system 10 can incorporate other output devices well-known in the art, e.g., graphics printers. Moreover, the CPU 12 can access a timer 30 in accordance with conventional principles.

Figure 2:
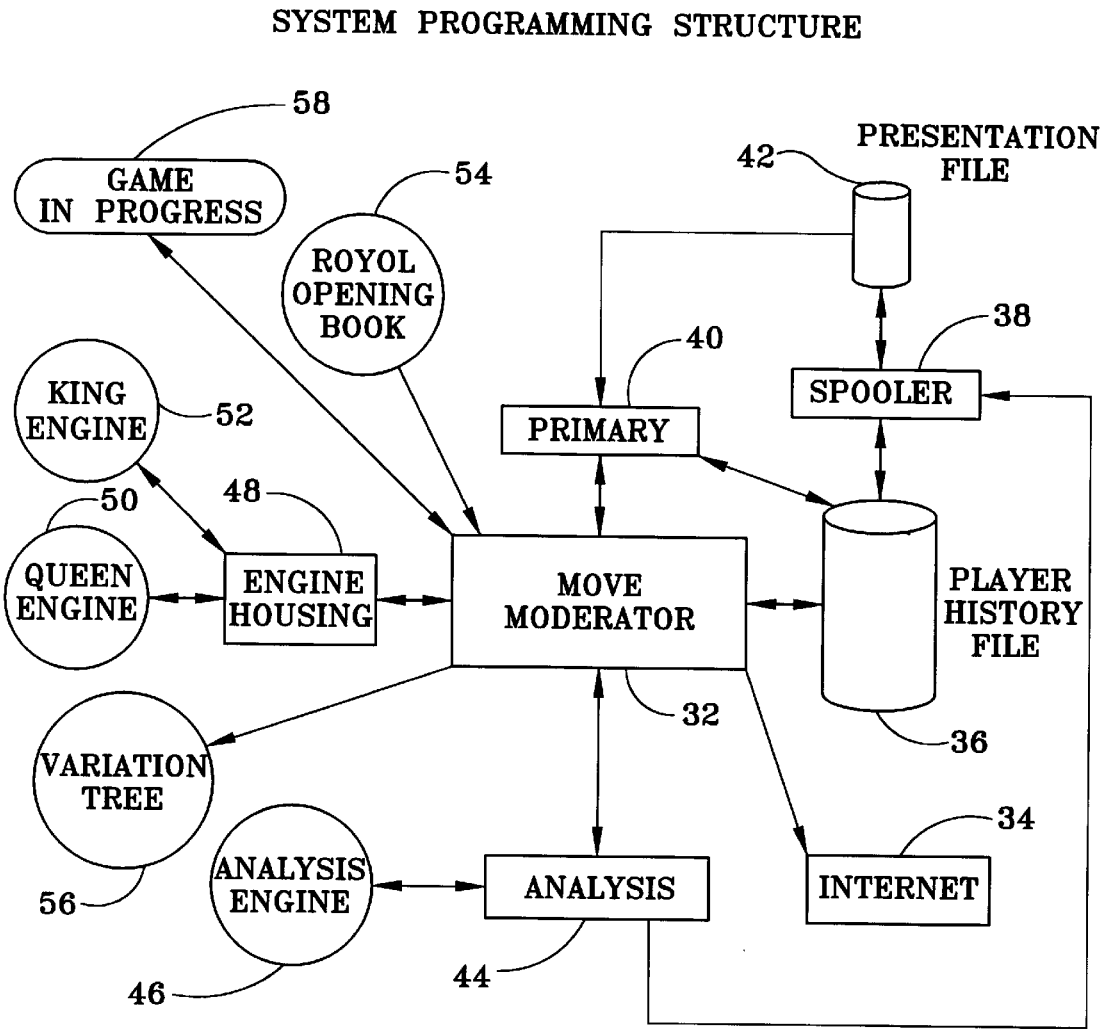
FIG. 2 is a block diagram showing the overall programming structure of the present system.

FIG. 2 shows the overall program structure of the system 10. Per the present invention, the present program structure is object based. A move moderator object 32 controls the overall flow of the game by obtaining player moves and computer moves at the appropriate times and ensuring that the player moves are legal chess moves. In one application, the move moderator 32 can access the Internet 34 such that a player can play chess using the present system from a location remote from the CPU 12.

Also, the move moderator 32 accesses a player history file 36 that contains the records of games played by one or more players of the system 10. In turn, the player history file 36 is accessible by a spooler 38 and a primary thread object 40. The purpose of the spooler 38 is to spool, to a presentation file 42 for storage thereof, ROYOL codes for subsequently cause enactment of an audio-visual commentary of the player's game, as generated in part by an analysis thread 44 that communicates with the move moderator 32, for immediate post game playback of the commentary. It can be appreciated in reference to FIG. 2 that in generating the analysis, the analysis thread 44 accesses an analysis engine 46, which is an instantiation of the uncrippled WChess™ engine.

In contrast, as described in greater detail below in reference to FIG. 3, the purpose of the primary thread object 40 is to interface player moves generated by the input devices shown in FIG. 1 with the move moderator 32. The primary thread object 40 also interfaces with the output devices shown in FIG. 1 to present an audio-visual representation of the game during play and post game. For presenting the post game analysis, the primary thread accesses the presentation file 42.

Additionally, the move moderator 32 communicates with two objects that generate computer moves. The first object is an engine housing object 48, which accesses both a queen engine 50 (also referred to herein as the "queen brain") and a king engine 52 (also referred to herein as the "kingbrain"). The queen brain 50 is an uncrippled instantiation of the WChess™ engine, it being understood that the queen brain 50 and analysis engine 46 can be implemented by the same chess engine instantiation. If desired, the player can elect to play against the queen brain. On the other hand, the kingbrain 52 is an instantiation of the WChess™ engine that has been adaptively crippled as appropriate for the player's level of skill, as demonstrated during previous games that the player has played on the system 10. As discussed in detail below, the function of the kingbrain 52 is to generate midgame moves (which includes moves to the end of the game) against the human player.

To render opening moves against the player, however, the move moderator 32 accesses an opening book object 54. The opening book object 54 contains one or more scripted plans that the system 10 will follow in rendering opponent moves to the player. Also, the opening book object contains scripted commentary for each move that is made in the book; consequently, the analysis thread object 44 does not analyze opening book moves, but only midgame moves made by both the kingbrain 52 and the player.

FIG. 2 shows that two other objects are also accessed by the move moderator 32. Specifically, the move moderator 32 sends move records to a variation tree object 56 for generation of a graphical visualization of the moves of the game. This graphical visualization is referred to herein as a "variation tree" and is discussed in greater detail below in reference to FIG. 10. The move moderator 32 also accesses a game in progress object 58, the purpose of which is to maintain a current game status record including the location of the various chess pieces.

Figure 3:
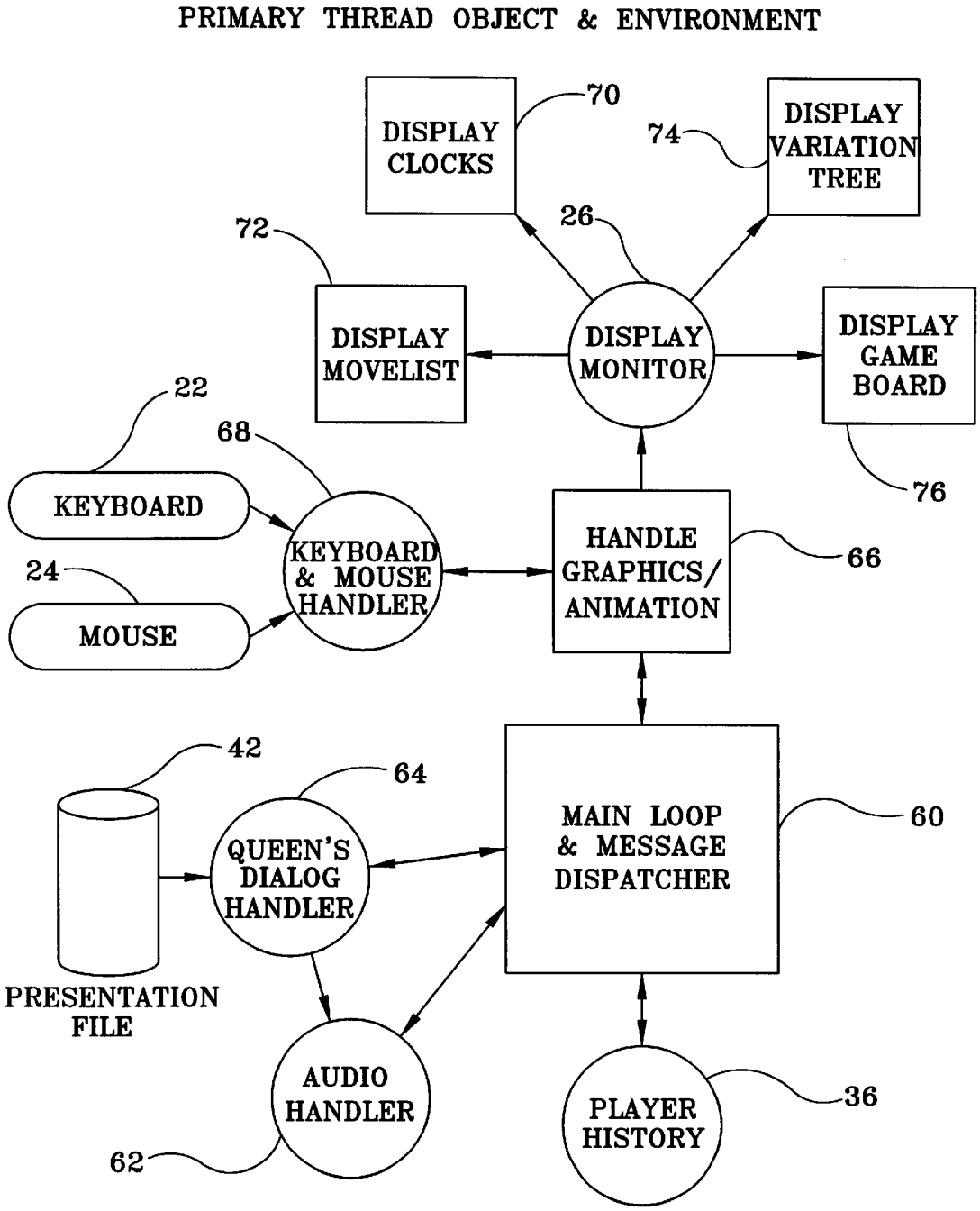
FIG. 3 is a block diagram showing the programming structure of the primary thread object of the present system.

Further details of the primary thread object are shown in FIG. 3. A main loop and message dispatcher object 60 interfaces with the player history file 36 as set forth above. Also, the main loop and message dispatcher object 60 interfaces with an audio handler 62 and a queen's dialog handler 64. The purpose of the dialog handlers 62, 64 is to generate an audio representation of the game, post game, from the data stored in the presentation file 42 during the game.

An input/output object, such as a graphics and animation object 66, is accessible by the main loop and message dispatcher object 60. To receive player input signals, the graphics and animation object 66 interfaces with a keyboard and mouse handler 68 that in turn receives signals from the keyboard 22 and mouse 24 as shown. In the preferred embodiment, to move chess pieces that are displayed on the monitor 26, the player manipulates the mouse 24 to click on a piece sought to be moved and then drag the piece to the desired square.

Figure 10:
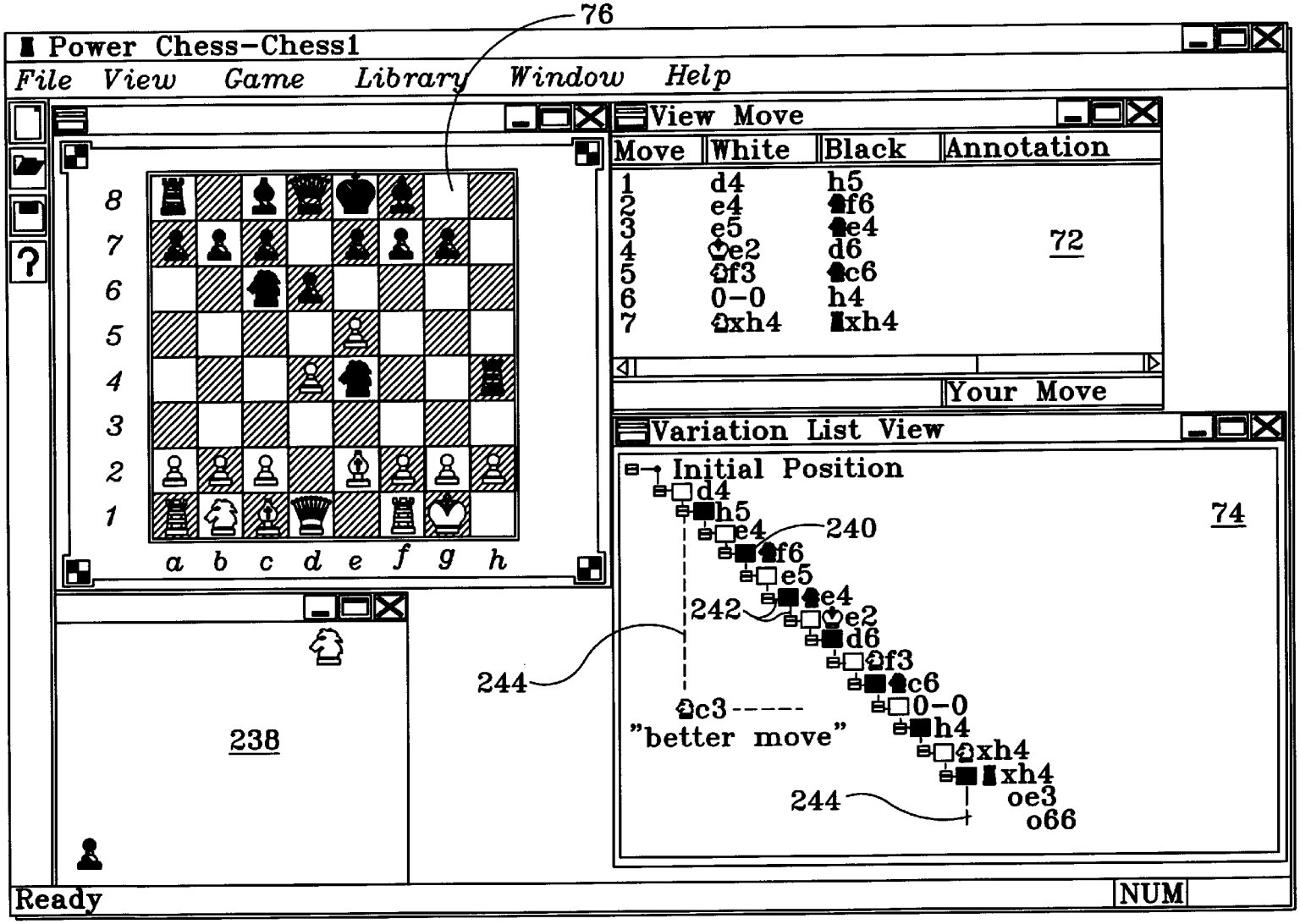
FIG. 10 is a screen display of the variation tree.

On the other hand, in undertaking its output function the graphics and animation object 66 interfaces with the monitor 26. As shown, the monitor 26 can present a visual display of a game clock 70, a move list 72, a variation tree 74, and a game board 76. In accordance with the present invention, the game clock 70 is an image of a digital clock that presents the time remaining for a player to complete a move. The move list 72 is a list of player and opponent moves generated in the current game, and as mentioned above and described in greater detail below, the variation tree is a graphical representation of the player and opponent moves generated in the current game. Also, the variation tree contains text annotations about the moves as generated by the queen brain. The game board 76 is a two dimensional or three dimensional image of a chessboard with pieces thereon as appropriate for the current game status. FIG. 10, discussed in greater detail below, shows examples of the move list 72, variation tree 74, and game board 76.

Figure 4:
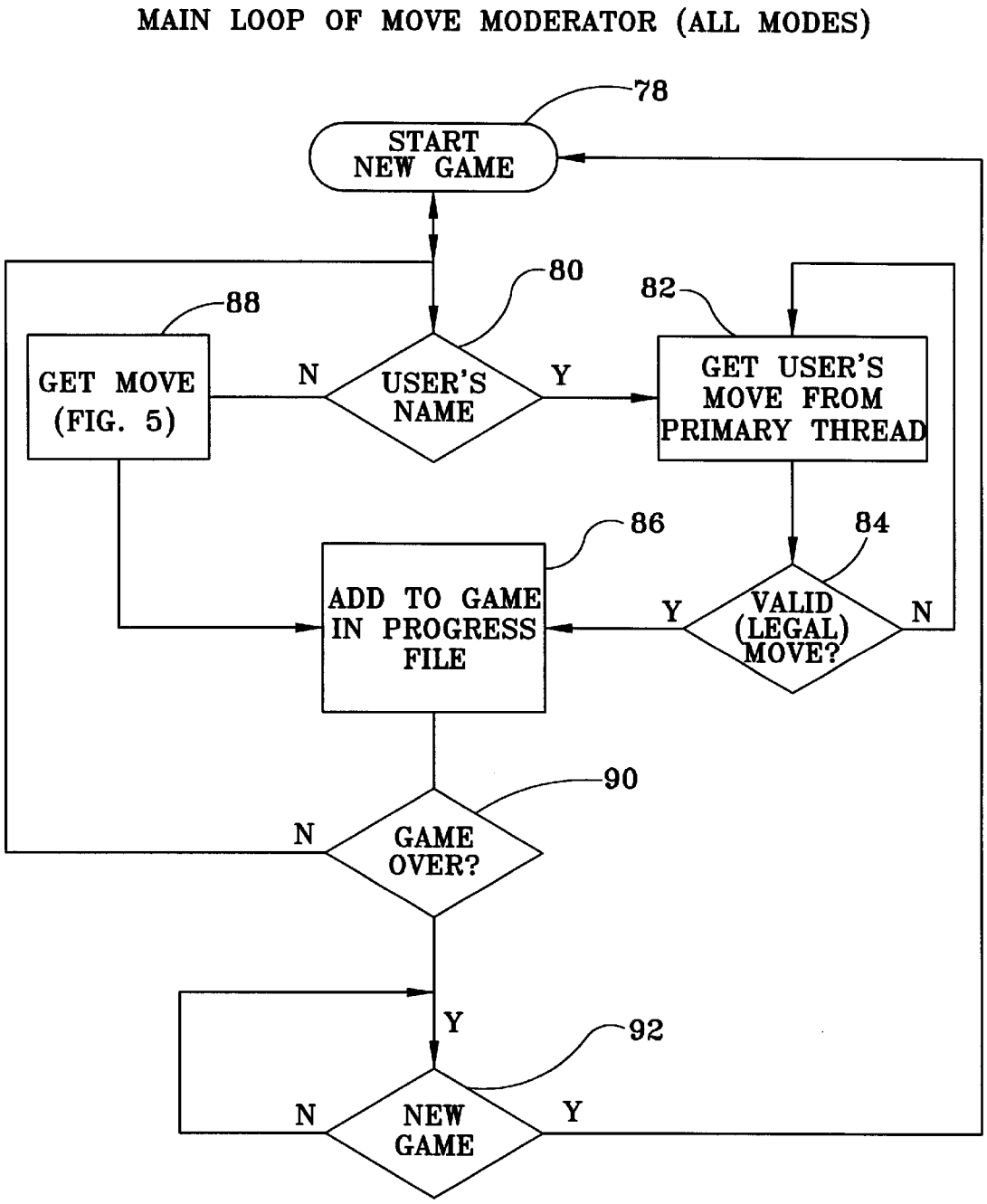
FIG. 4 is a flow chart showing the overall method steps executed by the move moderator.

FIG. 4 shows the logic undertaken by the move moderator 32. A new game is started at state 78, and at decision diamond 80 it is determined whether it is the player's turn to move. If it is, the logic flows to block 82 to obtain the player's move from the primary thread object 40. Then, the logic proceeds to decision diamond 84 to determine whether the player's move is a legal move. If it isn't, the logic loops back to block 82 to prompt the player that the move is not legal, and that another move must be made. Otherwise, the logic adds the player's move to the game in progress object 58 at block 86.

If it is determined at decision diamond 80 that it is the computer opponent's move, the logic flows to block 88 to retrieve the opponents move, as described in greater detail with reference to FIG. 5 below. From block 88, the logic moves to block 86 to add the opponent's move to the game in progress file 58, and then flows to decision diamond 90 to determine whether the game has ended, either by checkmate, draw, or resignation.

Unless the game has ended, the logic loops back to decision diamond 80; otherwise, the logic moves to decision diamond 92 to determine whether the player has indicated a desire to play another game. If the player has indicated a desire to play another game, the logic loops back to start state 78. On the other hand, if the player has not indicated a desire to play another game, the logic of the move moderator 32 stays in a loop between blocks 90 and 92 until such time as a player indicates a desire to start a new game.

Figure 5:
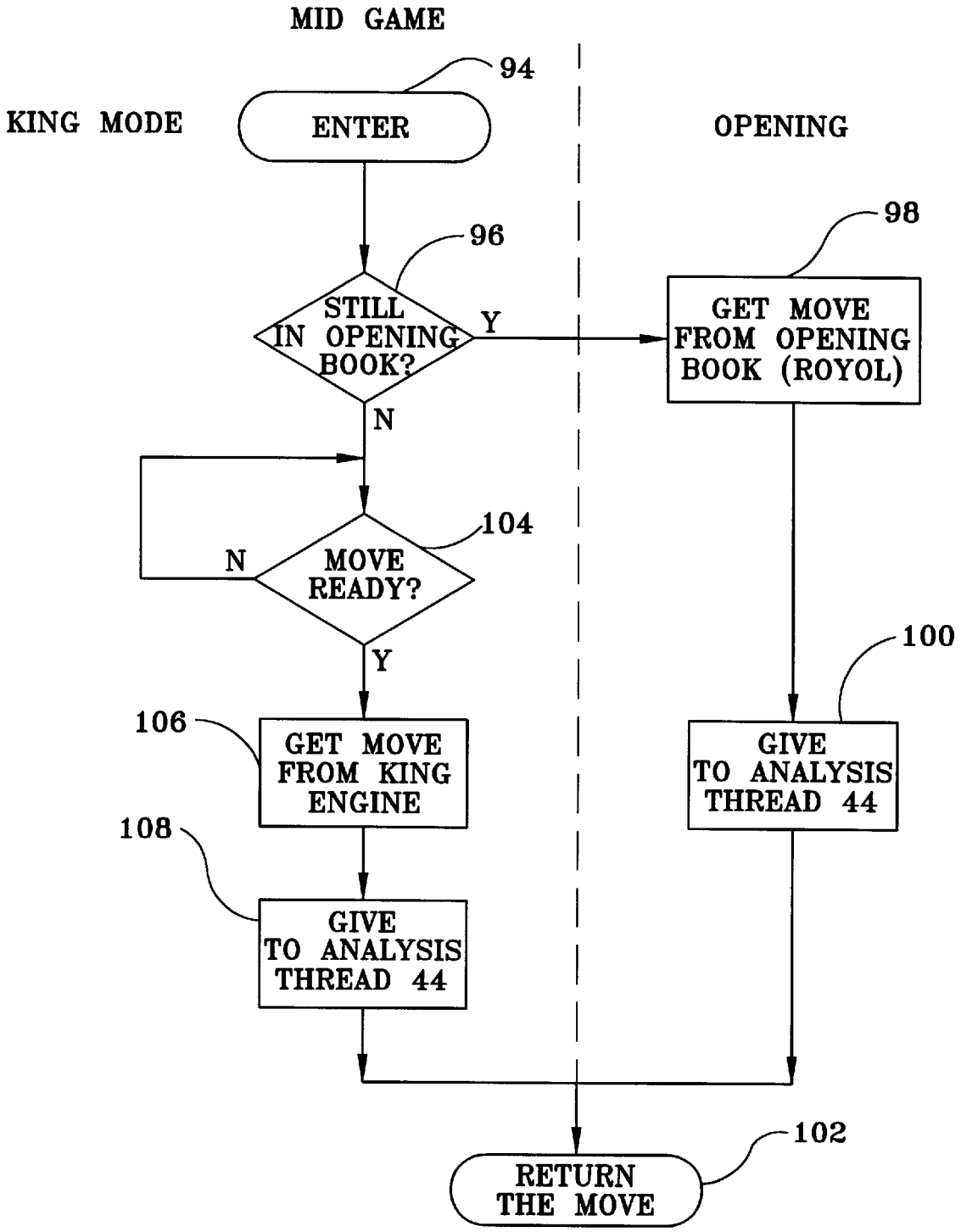
FIG. 5 is a flow chart showing the overall method steps in executing the opening book and the mid-game moves.

Now referring to FIG. 5, the logic of the move moderator 32 in determining the source from which to extract a computer opponent move can be seen. Commencing at state 94, the logic is entered, and the logic moves to decision diamond 96 to determine whether the game is still in the opening book. In undertaking this determination, the move moderator 32 determines whether the player has made a move that departs from the player moves envisioned by the opening book, or whether the player has refuted a kingbrain preprogrammed "mistake" and consequently has forced the kingbrain out of the opening book.

If the game is in the opening book, the logic moves to block 98 to access the opening book at the node of the book that is appropriate for the particular move. This move is returned to the analysis thread object 44 at block 100 for subsequent analysis thereof by the queen brain, used in the post game presentation. The logic continues to state 102 to return the move and add it to the game in progress file 48.

In contrast, if it is determined at decision diamond 96 that the game has departed the opening book, the logic moves to decision diamond 104 to determine whether the kingbrain 52 has generated a midgame move. As discussed further below, the kingbrain 52 generates midgame moves using an adaptively crippled instantiation of the chess engine. When the kingbrain has generated a midgame move, the logic continues to block 106 to retrieve the move, and then moves to block 108 to send the move to the analysis thread object 44. The logic continues to state 102 to return the move and add it to the game in progress file 48.

Figure 6:
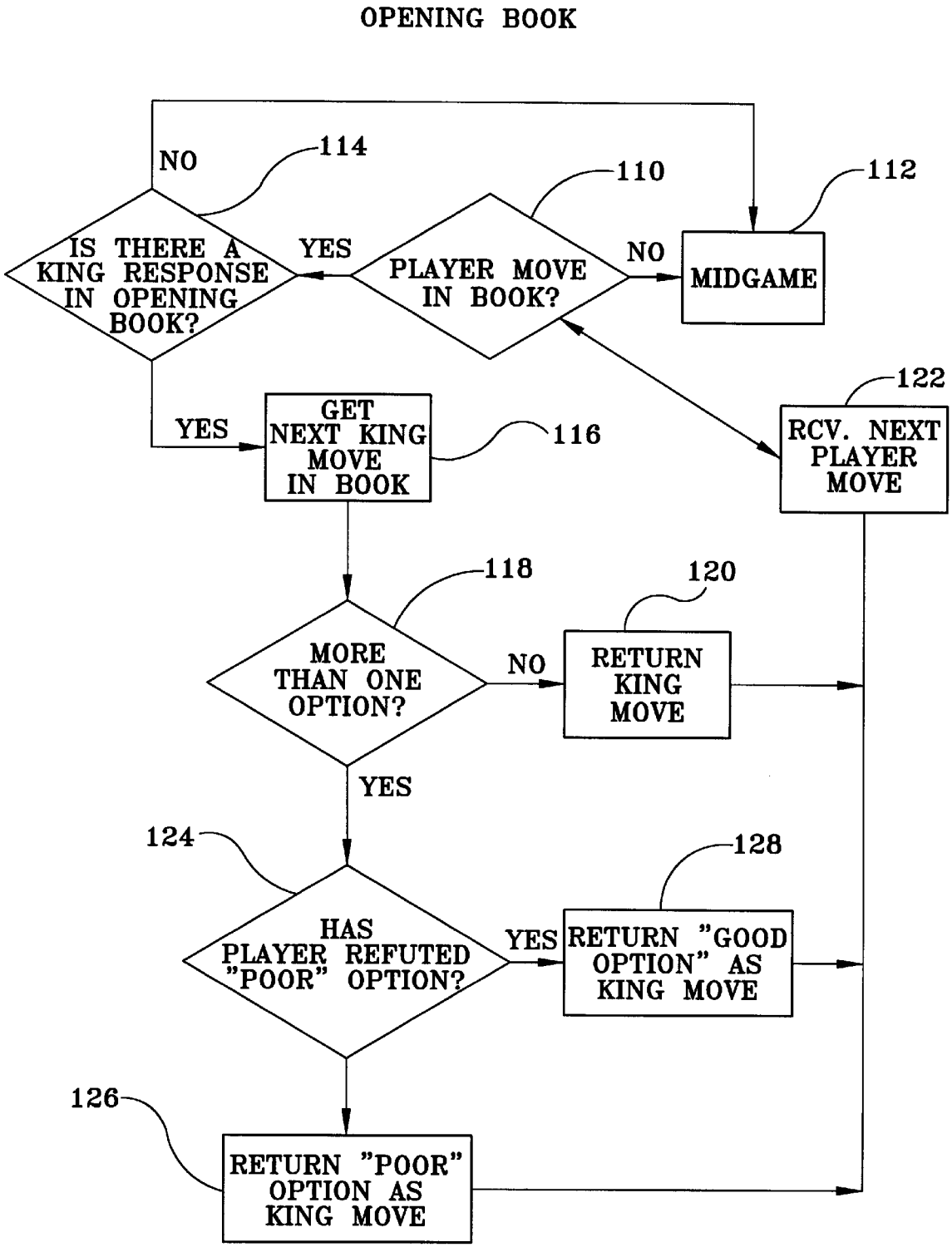
FIG. 6 is a flow chart showing the present opening book logic.

Now referring to FIG. 6, details of the opening book phase of the present chess game can be seen. Starting at decision diamond 110, the system logic determines whether the current player move is in the opening book for the node of the opening book that corresponds to the move. For example, for the player's first move of the game, the logic accesses the first node of the opening book at decision diamond 110. For the second move, the second node of the opening book is accessed, and so on. If the move is not at the appropriate node, the logic moves to block 112 to move to the midgame phase.

When the player move is in the opening book at the proper node, however, the logic moves to decision diamond 114 to determine whether a king response to the player's move exists in the opening book. If no king response is present in the opening book, the logic enters the midgame phase at block 112. Otherwise, the logic moves to block 116 to retrieve the next king move from the opening book from the appropriate opening book node.

From block 116 the logic moves to decision diamond 118 to determine whether more than one king move option is listed in the opening book for the node under test. If only one option is listed, the move is returned at block 120 as the computer opponent (i.e., kingbrain) move. The next player move is then received at block 122, and the logic moves back to decision diamond 110.

If more than one option exists in the opening book as determined at decision diamond 118, however, the logic flows to decision diamond 124 to determine whether the player, in a prior game, has refuted the "poorer" option listed at the node. By "refute" is meant countering the move in such a way that the player ultimately gained an advantage, if not outright victory. For the first game (and for all subsequent games until the player refutes the "poorer" option), the poor option is returned as the king move at block 126. Once a player has refuted the poorer option as determined at decision diamond 124, however, the logic returns the "better" option listed in the opening book at block 128 for all games subsequent to the one in which the poorer option was refuted. From blocks 126 and 128 the logic loops back to block 122 to receive the next player move.

Figure 7A:
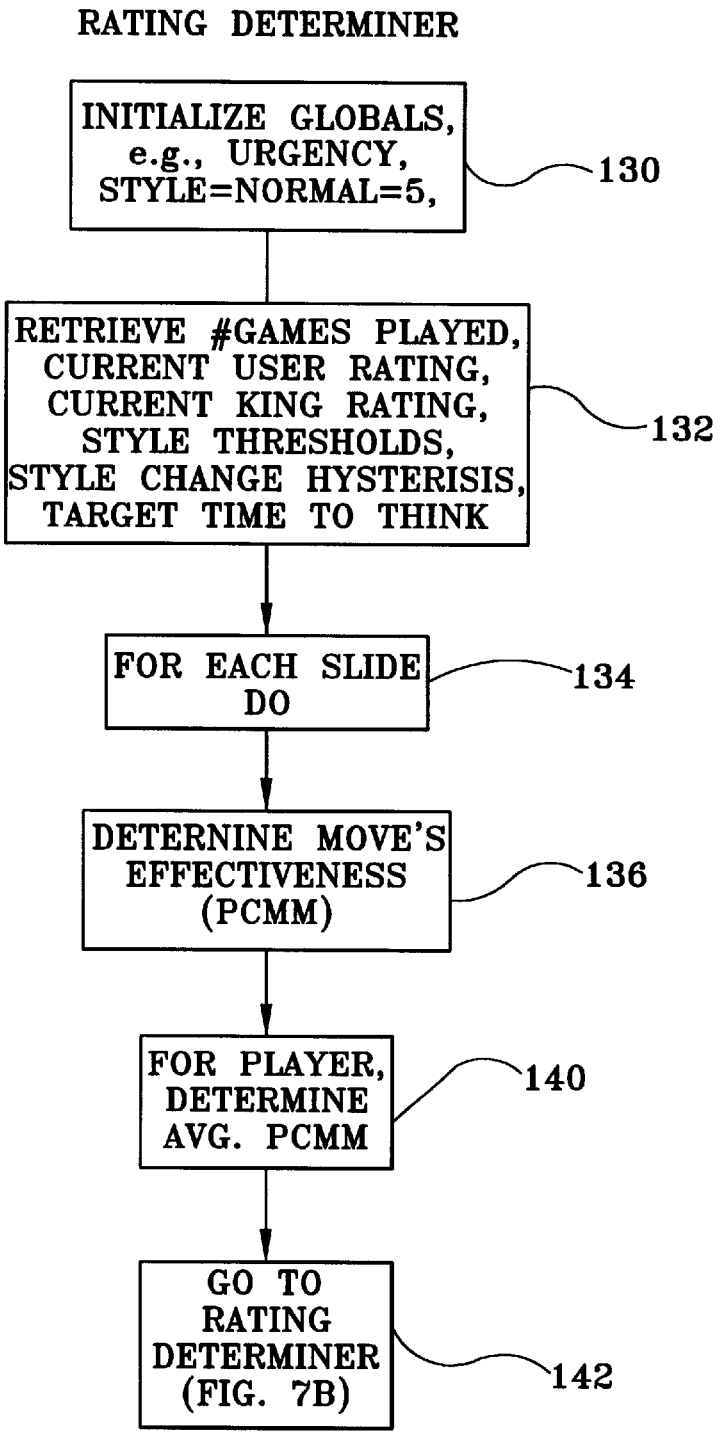
FIG. 7A is a flow chart showing the logic undertaken to determine Kingbrain rating (KRating) and the player's rating (PRating)

In understanding the midgame analysis process, reference is made to FIGS. 7A and 7B, which show how the Kingbrain strength (Kingrating, or simply KRating) is determined from prior games and then used in a current game to generate moves, as modified by the dynamism process disclosed below. During the midgame, the adaptively crippled kingbrain determines its moves, while the analysis engine (preferably the queen brain) analyzes the player's moves and, usually, the kingbrain's moves. This analysis establishes the analysis thread of the present invention, and as stated above, it is taken contemporaneously with the playing of the game.

It is to be understood that particular situation-unique exceptions can be provided to the below-described generalized establishment of the KRating. For example, if desired, the KRating can be set 200 points below the initial Player Rating (PRating) for the first game, to give the user a good chance to win; for more advanced players, the KRating can then be set to 300 points over the PRating for the second game, to psychologically "hook" the player by soundly defeating the player the second game, after allowing him to win the first. Also, if desired, once the total number of moves in any game exceeds a predetermined number, e.g., 50, the KRating can be immediately increased during the game to quickly end the game.

Commencing at block 130, certain global parameters are initialized. For example, an urgency variable is initialized to a value midway between high (e.g., 10) and low (e.g., 0) and a style variable is initialized to "normal". As discussed in greater detail below, the urgency variable indicates how far behind the game the analysis thread is, in "slides". Per the present invention, each slide is one half of one full move, with each full move being established by the combination of one player's slide and one kingbrain's slide.

As also discussed in greater detail below, the style variable indicates which one of three styles of play that the kingbrain has adopted, based on the kingbrain's evaluation of the game status. These styles include "heroic", which the kingbrain adopts when the kingbrain assesses that it is winning above a threshold value, conventionally measured in "pawns". The heroic style is characterized by comparatively high aggressiveness. Also, the kingbrain can adopt a "craven" when the kingbrain assesses that it is losing below a threshold value. The craven style is characterized by comparatively high defensiveness and low aggressiveness. Unless the kingbrain assesses heroic or craven condition, it plays with a neutral, or "normal", style.

Next, at block 132 additional variables are retrieved, including the total number of games played by the current player against the kingbrain, and the ratings of both the current player (referred to herein as "Player Rating" or "PRating") and the kingbrain (referred to herein as "King rating" or "KRating"). As disclosed in detail below, the kingbrain rating "KRating" represents the strength of the kingbrain. From another point of view, the KRating represents the amount by which the kingbrain is a crippled instantiation of the chess engine.

Also, based on the retrieved KRating, threshold values for adopting the heroic and craven styles are retrieved. Moreover, kingbrain hysterisis values for reverting to the craven style after having adopted the heroic style and then losing, and for reverting to the normal style after having adopted the craven style and then winning, are retrieved. Additionally, a target time for the kingbrain to think each move is retrieved at block 132.

From block 132, the logic moves to block 134, wherein the logic enters a "DO" loop for each slide during the midgame. At block 136, the queen brain or other uncrippled chess engine instantiation evaluates the slide's effectiveness, it being understood that the player's slides are always evaluated and the kingbrain's slides are evaluated provided the analysis thread is not excessively behind in its analysis.

To evaluate the slide's effectiveness, the queen brain undertakes the following analysis. A set of variables $eval_j$ is defined to be the queen brain's evaluations (based on accessing the uncrippled WChess™ engine) of particular slides, wherein j is the number of moves since leaving the opening book and wherein $eval_0=0$. Then, a variable $delta_eval_j$ is defined to be $eval_j-eval_j-1$. Next, the queenbrain evaluates the position before each move to render a "best" move, referred to as a variable $best_eval_j$. A variable max_error_value is set equal to $best_eval_j-eval_j$. The number of moves "$cnum_j$" between the best move and the move actually made by the player (or kingbrain) is determined and then normalized by dividing the number of moves "$cnum_j$" by the total number of possible moves that were available to the player to yield a variable "$norm_cnum_j$".

Next, the average difference between each of the moves between the best move and the move actually made is determined to yield a variable $avg_error_value_j$. After determining $avg_error_value_j$, the logic determines a power chess mistake metric ($pcmm_j$) to be equal to $(2*avg_error_value_j+max_error_value_j+norm_cnum_j)/3$. If $cnum_j=0$ (i.e., the player made the "best" move), $pcmm_j$ is set equal to −0.75. At block 140, the average of all pcmms for the midgame is determined and designated avg_pcmm. Then, at state 142 the logic moves to the steps shown in FIG. 7B.

Figure 7B:
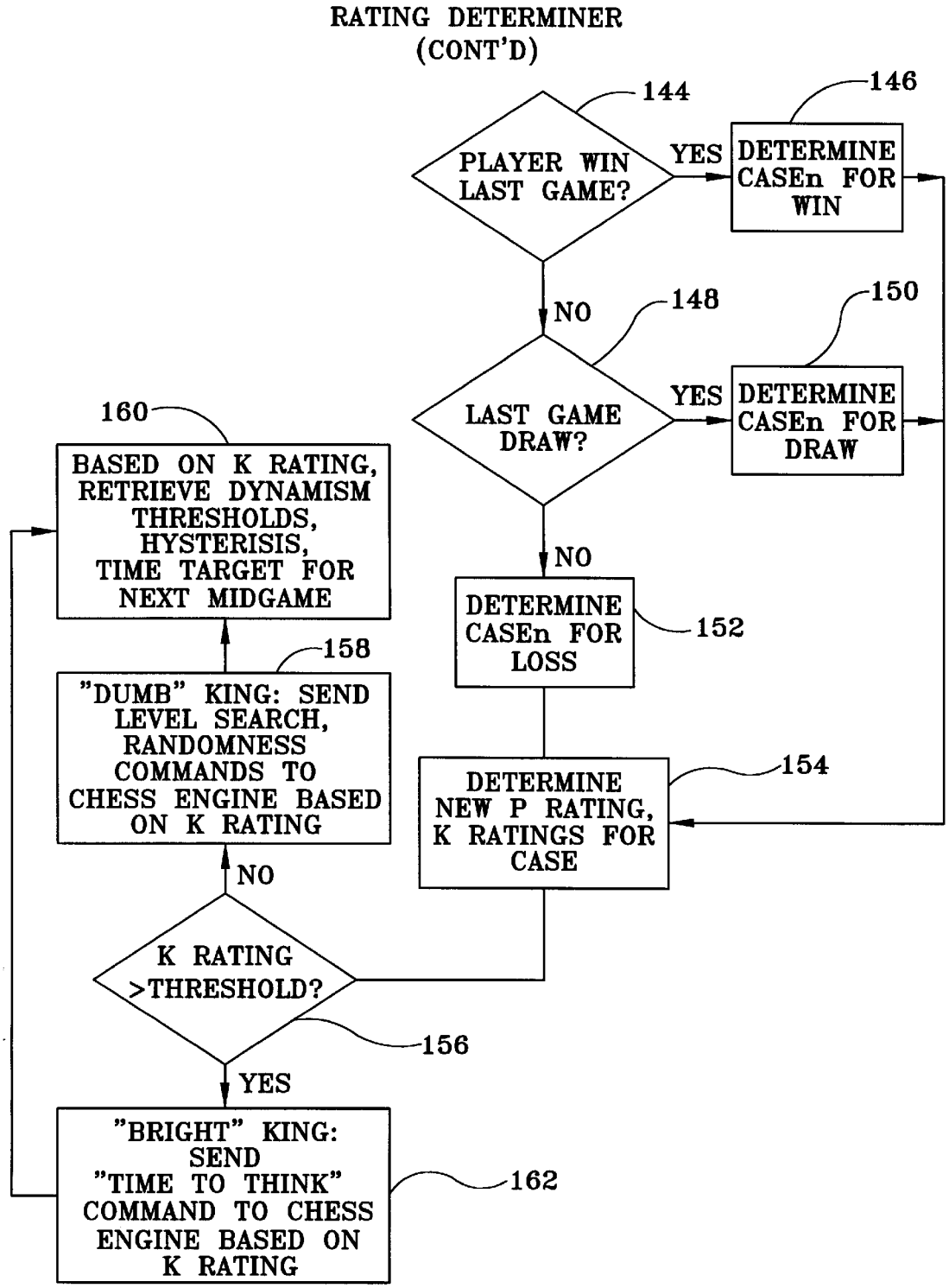
FIG. 7B is a flow chart showing the logic as it continues from FIG. 7A.

Commencing at decision diamond 144 in FIG. 7B, it is determined whether the player won the game just concluded. If so, the logic moves to block 146, to determine which one of "n" cases applies. More specifically, if the player won the last game and the game just prior to the last game, case 1 is indicated, whereas if the player's most recent victory before the last game was two games back, then case 2 is indicated, and so on, up to case n.

On the other hand, if it is determined that the player did not win the game just concluded, the logic moves to decision diamond 148 to determine whether the game just concluded was a draw. If it was, the logic proceeds to block 150 to determine which one of "n" cases applies. More specifically, if the player drew the last game and won the game just prior to the last game, case 1 is indicated, whereas if the player's most recent win before the last game draw was two games back, then case 2 is indicated, and so on, up to case n.

In contrast, if the player lost the last game, the logic moves from decision diamond 148 to block 152 to determine which one of "n" cases applies. More specifically, if the player lost the last game and won the game just prior to the last game, case 1 is indicated, whereas if the player's most recent win before the last game loss was two games back, then case 2 is indicated, and so on, up to case n.

Moving from block 146, 150, or 152 as appropriate, the logic next determines new a player rating (PRating) and a new kingbrain rating (KRating) for use in the next game as follows. First, a provisional status variable "ProvStatus" is set equal to the maximum of: 5-#games played, and 1. Thus, the ProvStatus variable always equals 1 after a predetermined number (e.g., 4) of "introductory" games has been played. Also, a raw player rating variable "PlayRawRC" is set equal to the maximum of 2000 minus the previous PRating, and 1, with the maximum then being divided by 4 and multiplied by ProvStatus/4 (i.e., PlayRawRC=((max((2000-PrevPRating), 1)/4)*(ProvSatus/4)). Likewise, a raw king rating variable "KingRawRC" is set equal to the maximum of 2450 minus the average of the previous PRating and KRating, and 1, with the maximum then being divided by 4 and multiplied by ProvStatus/4 (i.e., KingRawRC=((max((2450−((PrevPRating+PrevKrating)/2)), 1)/4)*(ProvSatus/4)).

With the above variables initialized, the following determinations are undertaken, depending upon the particular case determined above at blocks 146, 150, or 152:

I. Player Won Game just completed case 1 (indicating the player has won the last two games in a row, and that the strength of the kingbrain consequently should be increased significantly)−if PrevPRating>predetermined setpoint (e.g., 1200), set a variable adjFactor=1.15; otherwise adjFactor=2.0:

new PRat=CalcWinRating (previous PRat, PlayRawRC, adjFactor);

new KRat=CalcWinRating (previous KRat, KingRawRC, 2.5), wherein CalcWinRating=the product of the second and third variables, added to the first variable, but in any case at least as great as a floor value (e.g., 20) and no greater than a ceiling value (e.g., 2500).

case 2 (indicating the player has won 2 of the last 3 games, and that the strength of the kingbrain consequently should be increased moderately significantly−if PrevPRating>predetermined setpoint (e.g., 1200), set adjFactor=1.0; otherwise adjFactor=1.5:

new PRat=CalcWinRating (previous PRat, PlayRawRC, adjFactor);

new KRat=CalcWinRating (previous KRat, KingRawRC, 1.8)

case 3 (indicating the player's most recent win came after a prior win that was followed by two defeats, and that the strength of the kingbrain consequently should be increased only moderately)−if PrevPRating>predetermined setpoint (e.g., 1200), set adjFactor=0.9; otherwise adjFactor=1.1:

new PRat=CalcWinRating (previous PRat, PlayRawRC, adjFactor);

new KRat=CalcWinRating (previous KRat, KingRawRC, 1.25)

case 4 (indicating the player's most recent win came after a prior win that was followed by three defeats, and that the strength of the kingbrain consequently should be increased slightly)−if PrevPRating>predetermined setpoint (e.g., 1200), set adjFactor=0.85; otherwise adjFactor=1.0:

new PRat=CalcWinRating (previous PRat, PlayRawRC, adjFactor);

new KRat=CalcWinRating (previous KRat, KingRawRC, 0.3)

case 5 (indicating the player's most recent win came after a prior win that was followed by four defeats, and that the strength of the kingbrain consequently should be increased very slightly):

new PRat=CalcWinRating (previous PRat, PlayRawRC, 0.8);

new KRat=CalcWinRating (previous KRat, KingRawRC, 0.1)

case 6 (indicating the player's most recent win came after a prior win that was followed by five defeats, and that the strength of the kingbrain consequently should be decreased slightly:

new PRat=CalcWinRating (previous PRat, PlayRawRC, 0.7);

new KRat=CalcWinRating (previous KRat, KingRawRC, −0.2)

case 7 (indicating the player's most recent win came after a prior win that was followed by six defeats, and that the strength of the kingbrain consequently should be decreased significantly):

new PRat=CalcWinRating (previous PRat, PlayRawRC, 0.6);

new KRat=CalcWinRating (previous KRat, KingRawRC, −0.5)

case 8 (indicating the player's most recent win came after a prior win that was followed by seven defeats, and that the strength of the kingbrain consequently should be decreased very significantly):

new PRat=CalcWinRating (previous PRat, PlayRawRC, 0.5);

new KRat=CalcWinRating (previous KRat, KingRawRC, −1.0)

II. Player Drew Game just completed case 1 (indicating the player drew the last game after winning the previous game, and that the strength of the kingbrain consequently should be increased significantly):

newPRat=CalcWinRating(previous PRat, PlayRawRC, (0.7−(pcmm−2)/10));

newKRat=CalcWinRating(previous KRat, KingRawRC, (0.7−(pcmm−2)/5))

wherein pcmm=avg_pcmm determined above.

case 2 (indicating the player drew the last game after a win followed by a loss, and that the strength of the kingbrain consequently should be varied only moderately):

newPRat=CalcWinRating(previous PRat, PlayRawRC, (0.4−(pcmm−2)/10));

newKRat=CalcWinRating(previous KRat, KingRawRC/2, (0.4−(pcmm−2)/5))

case 3 (indicating the player drew the last game after a win followed by two losses, and that the strength of the kingbrain consequently should be decreased moderately):

newPRat=CalcWinRating(previous PRat, PlayRawRC, (0.4−(pcmm−2)/10));

newKRat=CalcWinRating(previous KRat, −KingRawRC, (0.4−(pcmm−2)/5))

case 4 (indicating the player drew the last game after a win followed by three losses, and that the strength of the kingbrain consequently should be decreased more than moderately):

newPRat=CalcWinRating(previous PRat, PlayRawRC, (0.4−(pcmm−2)/10));

newKRat=CalcWinRating(previous KRat, −KingRawRC, (0.6−(pcmm−2)/4))

case 5 (indicating the player drew the last game after a win followed by four losses, and that the strength of the kingbrain consequently should be decreased significantly):

newPRat=CalcWinRating(previous PRat, PlayRawRC, (0.4−(pcmm−2)/10));

newKRat=CalcWinRating(previous KRat, −KingRawRC, (0.5−(pcmm)/3))

case 6 (indicating the player drew the last game after a win followed by five losses, and that the strength of the kingbrain consequently should be decreased very significantly):

newPRat=CalcWinRating(previous PRat, PlayRawRC, (0.4−(pcmm−2)/10));

newKRat=CalcWinRating(previous KRat, −KingRawRC, (0.5−(pcmnm)/2))

III. Player Lost Game just completed special case -1: if the previous PRat>predetermined number (e.g., 1200) and the previous KRat<predetermined number (e.g., 800), indicating that a relatively highly rated player lost against a low strength kingbrain, an extra penalty is assigned as follows:

extraPen=(prevPRat−prevKRat)/minimum of 10, #games played special case 0: if the previous PRat<predetermined floor (e.g., 100) indicating that the player is doing very badly:

newPRat=CalcWinRating (previous PRat, −2, 1); and newKRat=CalcWinRating(previous KRat/2, 0, 1).

case 1 (indicating the player lost the last game after winning the previous game)−if PrevPRating>predetermined setpoint (e.g., 1200), set adjFactor=2; otherwise adjFactor=1:

newPRat=CalcWinRating(previous PRat, A, 1), wherein the second variable "A"=−minimum of ((lastPointGain)/(adjFactor+lastGainFromWin)*(pcmm+1.2)/3*(ProvStatus/10+0.9), and PlayRawRC), and further wherein lastPointGain is the amount of the most recent gain in points in PRat regardless of game outcome, and lastGainFromWin is the amount of the most recent gain in points in PRat from the most recent player win.

newKRat=CalcWinRating(previous KRat, B, 1), wherein the second variable "B"=−(lastPointGain)/(1+lastGainFromWin)*(pcmm+1.6)/3*(ProvStatus/5+0.8)

case 2 (indicating the player lost the last two games since winning a game)−if PrevPRating>predetermined setpoint (e.g., 1200), set adjfactor=2.5; otherwise adjFactor=2:

newPRat=CalcWinRating(previous PRat, A, 1), wherein the second variable "A"=−minimum of ((lastPointGain)/(adjFactor+lastGainFromWin)*(pcmm+1.2)/3*(ProvStatus/10+0.9), and KingRawRC);

newKRat=CalcWinRating(previous KRat, B, 1), wherein the second variable "B"=−((lastPointGain)/(1+lastGainFromWin)*(pcmm+1.6)/3*(ProvStatus/10)+0.9)

case 3 (indicating the player lost the last three games since winning a game)−if PrevPRating>predetermined setpoint (e.g., 1200), set adjFactor=2.8; otherwise adjFactor=3:

newPRat=CalcWinRating(previous PRat, A, 1), wherein the second variable "A"=−minimum of PlayRawRC, and ((lastPointGain)/(adjFactor+lastGainFromWin)*minimum of (1, and (pcmm+0)/3)*(ProvStatus/10)+0.9);

newKRat=CalcWinRating(previous KRat, B, 1), wherein the second variable "B"=−((lastPointGain)/(1+lastGainFromWin)*(pcmm+2)/3*(ProvStatus/2)+0.5)

case 4 (indicating the player lost the last four games since winning a game)−if PrevPRating>predetermined setpoint (e.g., 1200), set adjFactor=3.5; otherwise adjFactor=4:

newPRat=CalcWinRating(previous PRat, A, 1), wherein the second variable "A"=−minimum of PlayRawRC, and ((lastPointGain)/(adjFactor+lastGainFromWin)*minimum of (1, and (pcmm+0)/3);

In this case, set a variable KTemp=(lastPointGain)/(1+lastGainFromWin)*((pcmm+2.5)/3)*(ProvStatus)), and if KTemp<KingRawRC, reset KTemp=(Ktemp+KingRawRC)/2:

newKRat=CalcWinRating(previous KRat, −KTemp, 1).

case 5 (indicating the player lost the last five games since winning a game)−if PrevPRating>predetermined setpoint (e.g., 1200), set adjFactor=4; otherwise adjFactor=5:

newPRat=CalcWinRating(previous PRat, A, 1), wherein the second variable "A"=−minimum of PlayRawRC, and ((lastPointGain)/(adjFactor+lastGainFromWin)*minimum of (1, and (pcmm+0)/3);

In this case, set KTemp=(lastPointGain), and if KTemp<KingRawRC, reset KTemp=(Ktemp+2*KingRawRC)/3:

newKRat=CalcWinRating(previous KRat, −KTemp, 1).

case 6 (indicating the player lost the last six games since winning a game)–if PrevPRating>predetermined setpoint (e.g., 1200), set adjFactor=4.3; otherwise adjFactor=10:

newPRat=CalcWinRating(previous PRat, A, 1), wherein the second variable "A"=–minimum of 15, and (lastPointGain)/(adj Factor);

In this case, set KTemp=(lastPointGain), and if KTemp<KingRawRC, reset KTemp=KingRawRC:

newKRat=CalcWinRating(previous KRat, –KTemp, 1) if PrevPRating>predetermined setpoint (e.g., 1200), otherwise newKRat=CalcWinRating(previous KRat/2, 0, 1)

case 7 (indicating the player lost the last seven games since winning a game)–if PrevPRating>predetermined setpoint (e.g., 1200), set adjFactor=4.5; otherwise adjFactor=10:

newPRat=CalcWinRating(previous PRat, A, 1), wherein the second variable "A"=–minimum of 25, and (lastPointGain)/(adjFactor);

newKRat=CalcWinRating(previous KRat*5/6, 0, 1) if PrevPRating>predetermined setpoint (e.g., 1200), otherwise newKRat=CalcWinRating(previous KRat/2, 0, 1)

case default (indicating the player lost eight or more games in a row since winning a game)–if PrevPRating>predetermined setpoint (e.g., 1200), set adjFactor=4.5; otherwise adjFactor=10:

newPRat=CalcWinRating(previous PRat, A, 1), wherein the second variable "A"=–minimum of 25, and (lastPointGain)/(adjFactor);

newKRat=CalcWinRating(previous KRat*3/4, 0, 1) if PrevPRating>predetermined setpoint (e.g., 1200), otherwise newKRat=CalcWinRating(previous KRat/2, 0, 1)

For all of the above "loss" cases, the extraPen value determined above is deducted from the new player rating (newPRat). If the resulting value for newPRat<predetermined floor, e.g., 200, then a modified newPRat' is calculated as follows:

newPRat'=CalcWinRating(prevPRat, ½(newPrat–prevPRat), 1)

Also, if the absolute value of (newPRat–prevPrat)<8, then a modified newPRat' is returned to equal prevPRat–9.

Moving from block 154 to decision diamond 156, it is determined whether the new king rating is above or below a predetermined threshold value, e.g., 1500. If the new rating is below the threshold, the conditions for a "dumb" kingbrain are indicated, and the logic consequently moves to block 158. At block 158, the appropriate values of the particular chess engine being instantiated are established in accordance with the king rating to cripple the chess engine. When the WChess™ is used, its 1n, 1s, and v parameters are established to establish the levels of the search the kingbrain will be limited to for each move, and to establish a randomness of the kingbrain's evaluation of the moves searched. In establishing the values of the appropriate chess engine parameters, a table of values such as the table contained in the attached microfiche appendix can be used to correlate king ratings at every, e.g., 5 points between 0 and 1500to corresponding values for the chess engine parameters.

From block 158, the logic flows to block 160 to retrieve the dynamism thresholds discussed above, for use in the next midgame. These dynamism values, like the chess engine parameters, can be obtained by a table lookup which correlates a set of values to each kingbrain rating at predetermined rating value intervals.

On the other hand, if it is determined at decision diamond 156 that the new king rating is above the predetermined threshold value, a "bright" kingbrain is indicated. In contrast to "dumb" kingbrains, for "bright" kingbrains, the chess engine being instantiated preferably is crippled by limiting its time to think about each move by establishing the appropriate time-related chess engine values. The target time to think established for "bright" kingbrains is obtained through a table lookup to correlate values of KRat to values for time to think, with "brighter" kingbrains being allotted more time to think than less bright kingbrains. The logic then moves from block 162 to block 160.

In either the "bright" or "dumb" kingbrain case, however, it may now be appreciated that the strength of the kingbrain for the next game is established based on the new king rating, which, as set forth above, depends on the quality of the player's moves in at least one prior game. Thus, the kingbrain automatically adapts to the player's skill level as demonstrated by the player's moves.

Also, as set forth above "dumb" kingbrains are established by limiting the depth of search and increasing randomness of kingbrain evaluation, whereas "bright" kingbrains are established by limiting the time allotted for the kingbrain to think about a move. It is to be understood, however, that in no case will the time allowed to a kingbrain to think for any move be allowed exceed 1/10 of the expected time remaining in the game, or to exceed an upper limit; nor will the time be permitted to be less than a minimum value, e.g., 2 seconds. Also, the analysis thread ensures that the analysis engine 46 (usually the queen brain) is always given more time to think about a kingbrain's moves than the kingbrain is given to think.

Figure 8A:
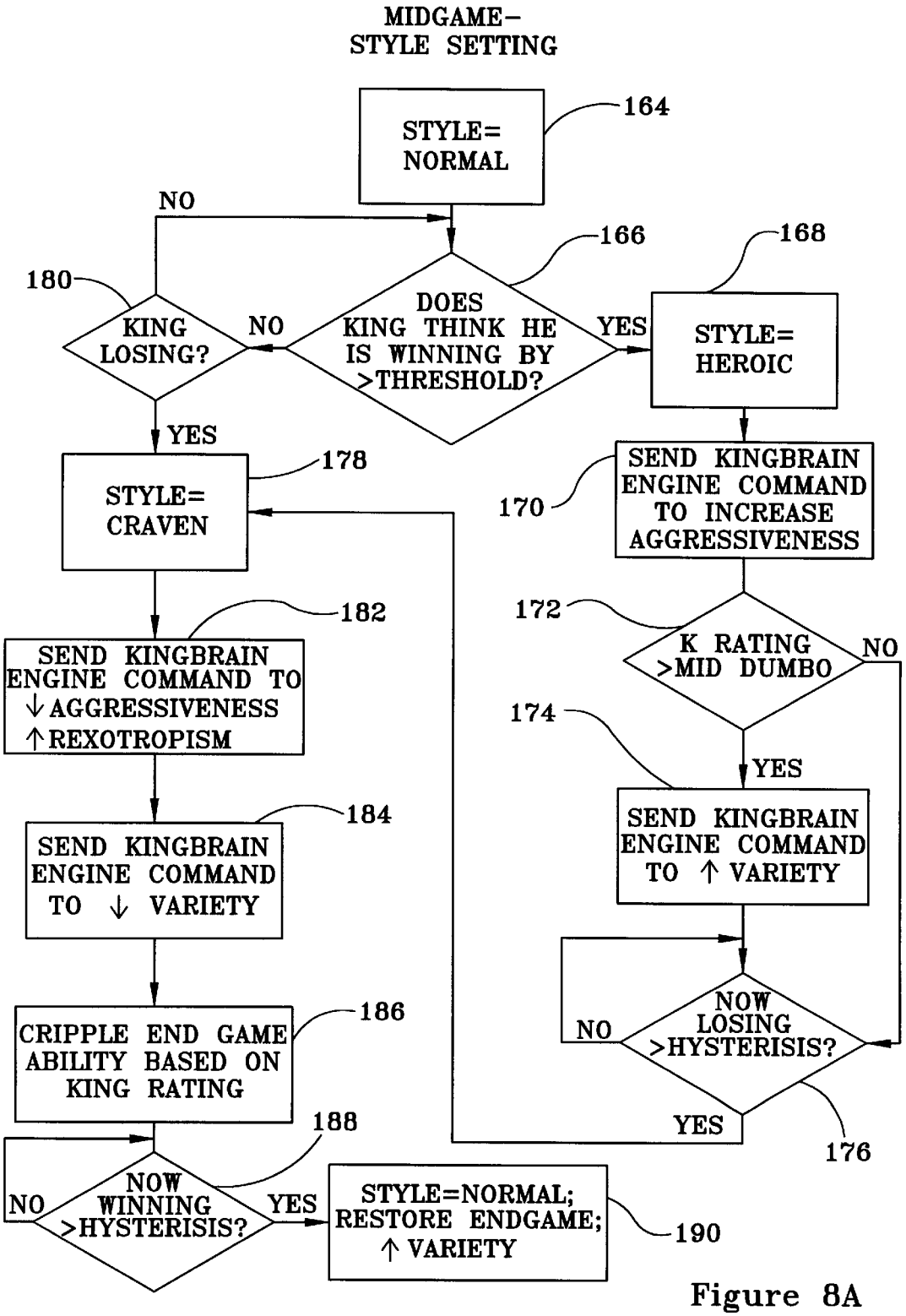
FIG. 8A is a flow chart showing the logic undertaken to determine Kingbrain style during the midgame.

FIG. 8A shows the logic for dynamically varying the kingbrain's style of play (and as a consequence, at least indirectly varying the kingbrain's strength) during play of the game, based at least in part on the player's moves. Commencing at block 164, the kingbrain's style is set to "normal", in which the kingbrain exhibits normal aggressiveness characteristics within the confines of its strength rating established above. Moving to decision diamond 166, it is determined whether the kingbrain's assessment of the game (as rendered within the confines of its crippling) indicates that the kingbrain is winning the game beyond the "heroic" threshold value (typically in terms of pawns ahead) that is established based on the KRating as discussed above. It is to be understood that the kingbrain makes his assessment in the same manner as the analysis engine makes its evaluations set forth above, within the limits of the kingbrain's strength. If the kingbrain assesses that it is winning above the heroic threshold, the logic moves to block 168 to indicate that the kingbrain should adopt a heroic style of play.

In accordance with the present invention, the logic moves to block 170, wherein the kingbrain adopts a heroic style of play characterized by comparatively high aggressiveness, with the appropriate aggressiveness parameters of the chess engine being increased to achieve this result. From block 170, the logic moves to decision diamond 172 to determine whether the kingbrain is "smarter" than a mid-range "dumb" king, i.e., whether the KRating exceeds a threshold value, e.g., 1000. If so, the logic moves to block 174 to send the chess engine the appropriate command to increase the randomness of move selection, to thereby mirror the risk-taking characteristics of an aggressive player. In so doing, the kingbrain moves more quickly than it would otherwise (thus potentially losing some strength if a "bright" kingbrain).

From block 174, or from decision diamond 172 if the test there was negative, the logic moves to decision diamond 176 to determine whether the kingbrain's assessment of the game situation indicates that the kingbrain is losing at a level of more than the hysterisis value obtained as set forth above (typically in terms of pawns behind). If so, the logic moves to block 178 to adopt a "craven" style of play, wherein the kingbrain exhibits relatively low aggressiveness and relatively high defensiveness. The skilled artisan will appreciate that the effect of maintaining the heroic style until well after the kingbrain begins to lose simulates the reluctance of an aggressive player to admit that he is no longer winning until perhaps it is too late. Also, causing a losing heroic kingbrain to assume the craven style and not the normal style once it assesses that it is losing simulates the depression that an aggressive player might undergo when faced with a disadvantageous position.

Recall that at decision diamond 166 it is determined whether the kingbrain assesses that it is winning beyond the heroic threshold. If not, the logic moves to decision diamond 180, wherein the kingbrain assesses whether it is losing beyond the craven threshold. If it is, the logic moves to block 180 to adopt the craven style and thence to block 182 to implement the craven style by sending a kingbrain chess engine command to reduce its aggressiveness and increase its defensiveness. In the WChess™ engine, it is possible to establish a value for a parameter that effects the engine's "rexotropism", i.e., its propensity to gather its pieces by its own king piece in a defensive posture or to advance its pieces near the opponent's king in an offensive posture, respectively depending on whether the king has assumed a craven or heroic style.

In addition to decreasing its aggressiveness and increasing its defensiveness, a command is sent to a craven kingbrain at block 184 to decrease the variety of moves rendered by the kingbrain chess engine. Moreover, at block 186 the endgame ability of a craven kingbrain is crippled in proportion to the kingbrain strength (KRating) by sending the appropriate endgame strength command to the chess engine.

From block 186 the logic moves to decision diamond 188 to determine whether the kingbrain assesses that it is winning beyond the craven-normal hysterisis value obtained based on the KRating as set forth above. If it is, the logic moves to block 190 to cause the kingbrain to adopt the normal style, restore the endgame capability of the kingbrain, and increase the variety of the kingbrain's moves. The skilled artisan will appreciate that the effect of maintaining the craven style until well after the kingbrain begins to win, and then only adopting the normal style and not the heroic, simulates the reticence of a losing player to recognize that the tide of the game has turned and that it is appropriate to take the offensive. In any case, it may now be appreciated that the style and, at least indirectly, the strength of the kingbrain automatically adapts based at least in part on the player's moves.

As understood by the present invention, "bright" kingbrains are allotted more time to think about each move than "dumb" kingbrains, and the brighter the kingbrain, the more time it is allotted to think. As further understood by the present invention, the analysis engine must also be given time to think about both the player's moves and, preferably, about the kingbrain's moves, both to update the kingbrain rating as discussed above and to generate a post-game analysis for immediate playback to the player after the game ends. However, the present invention recognizes the desirability of avoiding undue game delays.

Figure 8B:
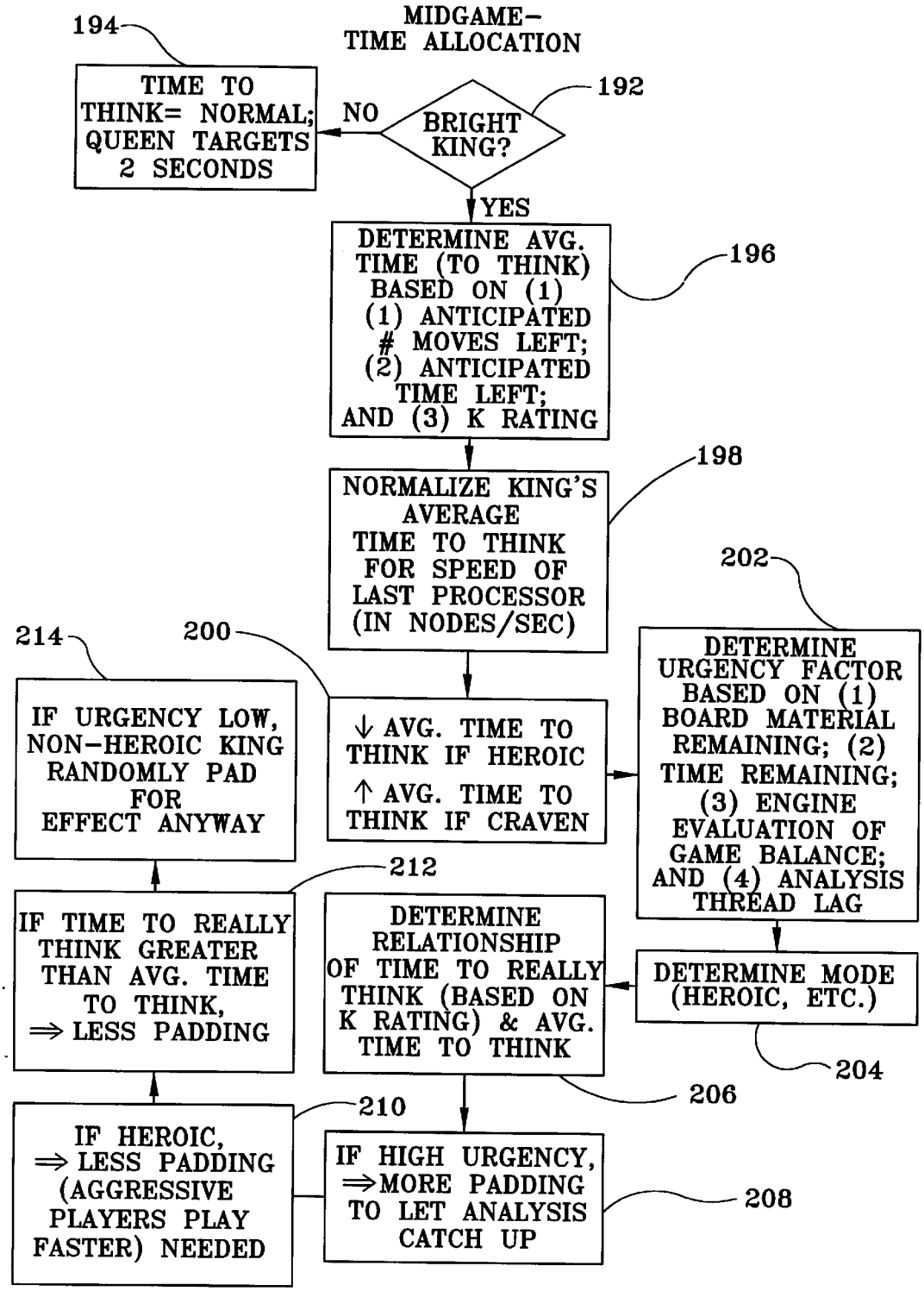
FIG. 8B is a flow chart showing the logic undertaken to allocate time during the midgame between the analysis thread and the Kingbrain analysis.

Accordingly, FIG. 8B shows the time allocation logic during the midgame phase of the present invention. Commencing at decision diamond 192, it is determined whether the present kingbrain instantiation is "bright" or "dumb", in accordance with the principles discussed above. If the kingbrain is "dumb", the logic moves to block 194, wherein the kingbrain's time to think is set at a nominal, de minimis value, since the engine crippling for the kingbrain (i.e., limiting levels of search and increasing randomness) do not require the underlying crippled chess engine to use much processing time. For the "dumb" kingbrain, the queen brain is allocated a predetermined time, e.g., not to exceed two seconds, to think about each kingbrain slide.

On the other hand, if the kingbrain is a "bright" kingbrain, the logic moves to block 196 to determine an average time to think about each move based on the anticipated number of moves remaining in the game as evaluated by the queen brain, the anticipated time remaining in the game as evaluated by the queen brain, and the strength of the kingbrain (KRating). This average time to think is then normalized at block 198 to account for the speed and activity level of the host processor, as represented by how many chess engine nodes per second the host processor can currently search.

With the average time to think thus normalized, the process moves to block 200. As mentioned above, the average time to think is increased or decreased based on whether the kingbrain is undertaking the heroic and craven styles, respectively.

Moving to block 202, an urgency factor is next determined. This urgency factor increases as the amount of board material (i.e., chess pieces remaining) decreases, as the time remaining in the game as evaluated by the queen brain decreases, as the game becomes more imbalanced as evaluated by the queen brain (indicating that the game is nearing its conclusion), and as the number of slides by which the analysis thread lags the game increases. Thus, the urgency factor is a measure of how far the analysis thread lags the game play, with a higher urgency generally indicative of a situation in which the game potentially is nearly over and the analysis thread significantly lags the game play and, hence, that it is urgent that the analysis thread catches up to the game play so that the analysis shown in FIG. 9 can be immediately presented to the player at the end of the game.

Moving to block 204, the logic ascertains the style mode of the kingbrain with the understanding that a "heroic" kingbrain should appear to move faster than a "normal" kingbrain and a "craven" kingbrain and, thus, that less time is available per move than would otherwise be the case.

Moving from block 204 to block 206, the relationship between the kingbrain's "time to really think" as established pregame by the kingbrain strength (KRating) and the normalized average time to think established at block 198 is determined. With this relationship determined, the logic proceeds to block 208 to increase a "padding" variable in proportion to the urgency. Per the present invention, the padding variable is a time period value, in seconds, that exceeds the kingbrain's actual time to think and that is added to the kingbrain's actual time to think before returning a computer opponent move to the player. This gives the illusion to the player that the kingbrain is mulling over a move longer than the kingbrain engine actually requires. By increasing the padding, the analysis is allowed to catch up to the game play during the padding period. It is to be understood that the analysis also uses the player's move period to catch up to the game play.

From block 208 the logic moves to block 210, wherein the padding variable is decreased if the kingbrain is in the heroic mode, urgency permitting. This is to model the propensity of an aggressive opponent to move quickly, without excessive analysis between moves.

Next, at block 212, the padding variable is decreased if the actual time required by the kingbrain to think (as established by the kingbrain rating KRating) is greater than the normalized average time to think obtained at block 198, urgency permitting. Then, at block 214, the padding variable is randomly increased even when the kingbrain is not in the heroic mode and little urgency exists, again to simulate the playing style of a human opponent who might sometimes move slowly and sometimes quickly.

Figure 9:
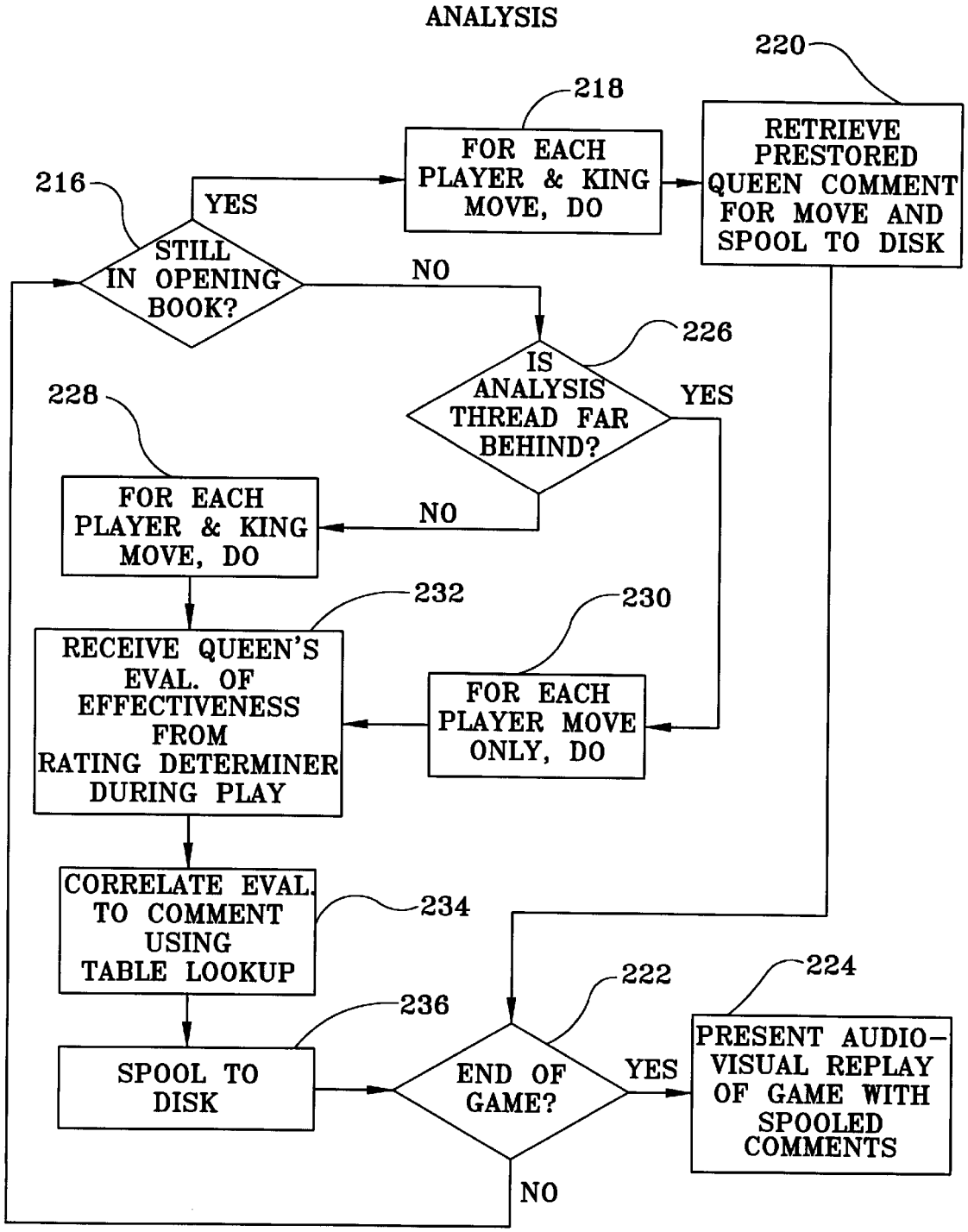
FIG. 9 is a flow chart showing the logic of the analysis thread.

FIG. 9 shows the logic of the analysis thread of the present invention. Commencing at decision diamond 216, it is determined whether a slide sought o be analyzed is in the opening book. If it is, the logic moves to block 218, wherein for each player slide and kingbrain slide, a DO loop is entered. At block 220, a queen comment that has been prestored and correlated to the particular opening book slide being analyzed is retrieved and spooled to the hard disk drive 18. The logic then moves to decision diamond 222, wherein it is determined whether the slide being analyzed is the last of the game. If not, the logic returns to decision diamond 216 to test whether the next slide for analysis is in the opening book. Otherwise, the logic ends at block 224, wherein an audio-visual replay of the game is presented to the player, along with the analysis comments, move-by-move. This game replay includes an animated rendering of a queen speaking the comments, along with a depiction of the gameboard and pieces as they are moved from the beginning of the game to the end in synchronization with the spoken commentary.

When it is determined at decision diamond 216 that a slide sought to be analyzed is not in the opening book, indicating that the analysis engine 46 shown in FIG. 2 must analyze the move, the logic proceeds to decision diamond 226 to determine whether the analysis thread, as indicated by the urgency value determined in FIG. 8B, significantly lags the game play. If the analysis thread is more or less "caught up" with the game play, the logic enters a DO loop at block 228 for each player slide and each kingbrain slide. Otherwise, the logic enters a DO loop at block 230 for each player slide only. Thus, under high urgency conditions only the player slides are analyzed by the analysis engine.

From block 228 or block 230, the logic proceeds to block 232. At block 232, the logic receives the queen brain's evaluation of the effectiveness of the slide being analyzed from the rating determined disclosed above. In other words, the queen brain (analysis engine) evaluates the slide actually made against a hypothetical "best" move as determined by the analysis engine.

Moving to block 234, the analysis thread logic correlates the queen brain's evaluation to a spoken comment by accessing a lookup table of comments. For example, the table can be structured with, e.g., 20 comments being associated with a slide evaluated as being nearly or exactly "correct", with one of the comments being randomly selected from the group of 20. Among this group of comments might be "way to go!", "on target!" and so on for player slides, and "your opponent found the right move there" and the like for king slides.

Also, a group of comments can be associated with an evaluation that a slide is good, but perhaps not optimum. Likewise, groups of comments can be associated with other levels of evaluations. These comments are then spooled to the hard disk drive at block 236, with the logic then moving to decision diamond 222 to proceed as before.

FIG. 10 shows a screen view of the monitor 26 that is presented to the player postgame. As shown, the screen view can include the above-mentioned depictions and textual annotations of the game such as the move list 72 and variation tree 74, along with the game board 76. Also, a capture list 238 can be displayed to present visual representations of pieces captured during the game. It may now be appreciated that the move list 72 is simply a listing of moves, in conventional chess notation, that occurred during the game. Also, the game board 76 is a 2D or 3D depiction of a conventional chess board with pieces thereon.

In contrast, the variation tree 74 is a novel graphical presentation or annotation of the game that a player can visualize and manipulate to gain a better understanding of his or her play and to experiment with alternate moves. In the presently preferred embodiment, the variation tree 74 includes a graphical tree 240 that in turn includes lines 242 representing, in a single graphical display, all of the player moves and opponent moves for a game. As shown, the moves are depicted seriatim from upper left to lower right. Moreover, alternate lines 244 can be presented to represent alternate moves that might have been made, along with prestored comments from, e.g., the opening book relating to the alternate moves. These alternate lines can be generated from the preferred moves in the opening book, when the preferred moves have been departed from. Textual annotations regarding the moves can also be displayed. These annotations are derived from the queen brain.

In accordance with the present invention, the player can click on a particular move on the variation tree 74 to cause the pieces on the game board 76 to assume the positions they had during the game at the time of the selected move. Then, the player can move the chess pieces to alternate positions, and the variation tree 74 will automatically depict such moves as alternate lines 244. Or, the variation tree 74 can be manipulated by the player to present alternate lines 244, and to automatically cause the pieces depicted on the game board 76 to assume the positions in which they would have been had the alternate move been made. In this way, the player can explore ways in which he or she might have played an improved game.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims, in which reference to an element in the singular is not intended to mean "one and only one" unless explicitly so stated, but rather "one or more". The inventions illustratively disclosed herein may be practiced without any element which is not specifically disclosed herein.

What is claimed is:

1. A computer chess game system, comprising:

computer readable code means for accessing a chess engine kingbrain to generate opponent signals representative of opponent chess moves, the kingbrain being characterized by a kingbrain rating which automatically adapts to the skill level of a player based on the players moves in previous games in a multiple game match;

computer readable code means for receiving one or more player inputs representative of respective player moves;

computer readable code means for establishing a kingbrain rating in response to one or more of the player moves;

computer readable code means for comparing one or more of the player moves with a player plan of expected player moves;

computer readable code means for generating one or more opponent moves according to a predetermined plan if a player move does not deviate from said player plan;

computer readable code means for adapting one or more opponent moves based on player's ability if a player move deviates from said player plan; and computer readable code means for simultaneously accessing a chess engine queen brain for generating opponent moves that are not based on the player's ability;

wherein the kingbrain can be characterized by at least a heroic style characterized by high aggressiveness and a craven style characterized by high defensiveness, the system including computer readable code means to cause the kingbrain to assume the heroic style when at least one of: the kingbrain and queen brain, determines that the player is losing, the system including code means to cause the kingbrain to assume the craven style when at least one of: the kingbrain and queen brain, determines that the player is winning.

2. The computer chess game system of claim 1, wherein the kingbrain rating is established by establishing a processing time per move for the kingbrain.

3. The computer chess game system of claim 1, wherein the player can play a sequence of games using the system, and wherein the kingbrain rating is based at least in part on a kingbrain strength, the system including computer readable code means for establishing the kingbrain strength based on at least one game in the sequence of games.

4. The computer chess game system of claim 3, further comprising:

computer readable code means associated with the queen brain for comparing at least some player moves to hypothetical moves when the respective player signals are generated to generate a game analysis; and computer readable code means for generating an audible representation of the analysis.

5. The computer chess game system of claim 4, further comprising computer readable code means for generating a variation tree display, the variation tree display including a graphical tree including lines representing the player moves and opponent moves for a game.

6. An interactive game system, comprising:

a computer-implemented opponent kingbrain to generate opponent signals representative of opponent chess moves, the kingbrain being characterized by a kingbrain rating which automatically adapts to the skill level of a player based on the player's moves in previous games in a multiple game match;

means for receiving player signals from a player, the player signals being representative of player moves;

means responsive to the player signals for selectively establishing an expertise with which the opponent kingbrain counters the player moves in at least subsequent games;

computer readable code means for comparing one or more of the player moves with a player plan of expected player moves;

computer readable code means for generating one or more opponent moves according to a predetermined plan if a player move does not deviate from said player plan;

computer readable code means for adapting one or more opponent moves based on players ability if a player move deviates from said player plan; and computer readable code means for simultaneously accessing a chess engine queen brain for generating opponent moves that are not based on the player's ability;

wherein the kingbrain can be characterized by at least a heroic style characterized by high aggressiveness and a craven style characterized by high defensiveness, the system including computer readable code means to cause the kingbrain to assume the heroic style when at least one of: the kinqbrain and queen brain, determines that the player is losing, the system including code means to cause the kingbrain to assume the craven style when at least one of: the kinbrain and queen brain, determines that the player is winning.

7. The game system of claim 5, further comprising:

computer readable code means for comparing at least some player moves to hypothetical moves when the respective player signals are generated to generate a game analysis; and computer readable code means for generating an audible representation of the analysis.

8. The game system of claim 7, further comprising computer readable code means for generating a variation tree display, the variation tree display including a graphical tree including lines representing the player moves and opponent moves for a game.

9. A computer-implemented method for playing chess, comprising the steps of:

providing a kingbrain for generating opponent moves, the kingbrain being characterized by a kingbrain rating which automatically adapts to the skill level of a player based on the players moves in previous games in a multiple game match;

receiving player signals representative of player moves;

establishing a kingbrain rating based on at least one of: at least one player move, and a sequence of player moves;

comparing one or more of the player moves with a player plan of expected player moves;

generating one or more opponent moves according to a predetermined plan if a player move does not deviate from said player plan;

adapting one or more opponent moves based on player's ability if a player move deviates from said player plan; and simultaneously accessing a chess engine queen brain for generating opponent moves that are not based on the player's ability;

wherein the kingbrain can be characterized by at least a heroic style characterized by high aggressiveness and a craven style characterized by high defensiveness, the system including computer readable code means to cause the kingbrain to assume the heroic style when at least one of: the kingbrain and queen brain, determines that the player is losing, the system including code means to cause the kingbrain to assume the craven style when at least one of: the kingbrain and queen brain, determines that the player is winning.

10. The method of claim 9, wherein the kingbrain rating is established in response to each player move.

11. The method of claim 9, wherein the kingbrain rating is established by establishing a processing time per move for the kingbrain.

12. The method of claim 9, wherein the player can play a sequence of games using the system, and wherein the kingbrain rating is based at least in part on a kingbrain strength, the method including the step of establishing the kingbrain strength from game to game based on at least one game in the sequence of games.

13. The method of claim 12, further comprising the steps of:

comparing at least some player moves to hypothetical moves when the respective player signals are generated to generate a game analysis; and generating an audible representation of the analysis.

14. The method of claim 13, further comprising the step of generating a variation tree display, the variation tree display including a graphical tree including lines representing the player moves and opponent moves for a game.

15. An interactive computer game system, comprising:

at least one engine kingbrain to generate opponent signals representative of opponent chess moves, the kingbrain being characterized by a kingbrain rating which automatically adapts to the skill level of a player based on the player's moves in previous games in a multiple game match;

computer readable code means for receiving player signals representative of player moves;

computer readable code means associated with the engine kingbrain for comparing at least some player moves to a player plan of hypothetical moves when the respective player signals are generated to generate a game analysis;

computer readable code means for generating one or more opponent moves according to a predetermined plan if a player move does not deviate from said player plan;

computer readable code means for adapting one or more opponent moves based on player's ability if a player move deviates from said player plan;

computer readable code means for generating an audible representation of the analysis; and computer readable code means for simultaneously accessing a chess engine queen brain for generating opponent moves that are not based on the player's ability;

wherein the kingbrain can be characterized by at least a heroic style characterized by high aggressiveness and a craven style characterized by high defensiveness, the system including computer readable code means to cause the kingbrain to assume the heroic style when at least one of: the kingbrain and queen brain, determines that the player is losing, the system including code means to cause the kingbrain to assume the craven style when at least one of the kinqbrain and queen brain, determines that the player is winning.

16. The game system of claim 15, wherein the kingbrain rating is established by establishing a processing time per move for the kingbrain.

17. The game system of claim 15, wherein the player can play a sequence of games using the system, and wherein the kingbrain rating is based at least in part on a kingbrain strength, the system including computer readable code means for establishing the kingbrain strength from game to game based on at least one game in the sequence of games.

18. The game system of claim 15, further comprising computer readable code means for generating a variation tree display, the variation tree display including a graphical tree including lines representing the player moves and opponent moves for a game, the graphical tree being manipulable by the player to present lines representing at least alternate player moves.

19. A computer chess game system, comprising:

a chess engine kingbrain characterized by at least a heroic style characterized by a high aggressiveness and a craven style characterized by high defensiveness, said kingbrain further characterized by a kingbrain rating which automatically adapts to the skill level of a player based on the player's moves in previous games in a multiple game match;

means for receiving player signals representative of player moves; computer readable code means for comparing one or more of the player moves with a player plan of expected player moves;

computer readable code means for generating one or more opponent moves according to a predetermined plan if a player move does not deviate from said player plan;

computer readable code means for adapting one or more opponent moves based on players ability if a player move deviates from said player plan;

computer readable code means to cause the kingbrain to assume the heroic style when the kingbrain determines that the player is losing based at least in part on the player moves; and computer readable code means for simultaneously accessing a chess engine queen brain for generating of ponent moves that are not based on the player's ability;

computer readable code means to cause the kingbrain to assume the heroic style when at least one of: the kinqbrain and queen brains determines that the player is losing; and computer readable code means to cause the kingbrain to assume the craven style when at least one of: the kingbrain and queen brain, determines that the player is winning.

20. The system of claim 19, wherein the player can play a sequence of games using the system, and wherein the kingbrain rating is based at least in part on a kingbrain strength, the system including computer readable code means for establishing the kingbrain strength based on at least one game in the sequence of games.

21. The system of claim 19, further comprising:

computer readable code means associated with the queen brain for comparing at least some player moves to hypothetical moves when the respective player signals are generated to generate a game analysis; and computer readable code means for generating an audible representation of the analysis.

22. The system of claim 19, further comprising computer readable code means for generating a variation tree display, the variation tree display including annotations based on the game analysis and a graphical tree including lines representing the player moves and opponent moves for a game.

23. A computer-based strategic game system, comprising:

computer readable code means for accessing a chess engine kingbrain to generate opponent signals representative of opponent chess moves, the kingbrain being characterized by a kingbrain rating which automatically adapts to the skill level of a player based on the player's moves in previous games in a multiple game match;

means for receiving player signals representative of player moves;

means for generating opponent moves In response to the player moves;

computer readable code means for comparing one or more of the player moves with a player plan of expected player moves;

computer readable code means for generating one or more opponent moves according to a predetermined plan if a player move does not deviate from said player plan;

computer readable code means for adapting one or more opponent moves based on player's ability if a player move deviates from said player plan;

means for analyzing the player moves;

computer readable code means for simultaneously accessing a chess engine queen brain for generating opponent moves that are not based on the plaver's ability;

wherein the kingbrain can be characterized by at least a heroic style characterized by high aggressiveness and a craven style characterized by high defensiveness, the system including computer readable code means to cause the kingbrain to assume the heroic style when at least one of: the kingbrain and queen brain, determines that the player is losing, the system including code means to cause the kingbrain to assume the craven style when at least one of: the kingbrain and queen brain, determines that the player is winning; and means for generating a variation tree, the variation tree including a graphical tree including lines representing the player moves and opponent moves for a game.

24. The strategic game system of claim 23, wherein the player can play a sequence of games using the system, and wherein the kingbrain rating is based at least in part on a kingbrain strength, the system including means for establishing the kingbrain strength from game to game based on at least one game in the sequence of games.

25. A computer chess game system, comprising:

(a) a programmed data processor; and (b) programming associated with said programmed data processor for carrying out the operations of (i) receiving one or more player inputs representative of respective player moves, (ii) accessing a chess engine kingbrain to generate opponent signals representative of opponent chess moves, the kingbrain being characterized by a kingbrain rating which automatically adapts to the skill level of a player based on the player's moves in previous games in a multiple game match, (iii) establishing a kingbrain rating in response to one or more of the player moves, (iv) comparing one or more of the player moves with a player plan of expected player moves;

(v) generating one or more opponent moves according to a predetermined plan if a player move does not deviate from said player plan;

(vi) adapting one or more opponent moves based on player's ability if a player move deviates from said player plan; and (v) simultaneously accessing a chess engine queen brain for generating opponent moves that are not based on the players ability;

(vi) wherein the kingbrain can be characterized by at least a heroic style characterized by high aggressiveness and a craven style characterized by high defensiveness, the system including computer readable code means to cause the kingbrain to assume the heroic style when at least one of: the kingbrain and queen brain, determines that the player is losing, the system including code means to cause the kinqbrain to assume the craven style when at least one of: the kingbrain and queen brain, determines that the player is winning.

26. A chess program, comprising a set of instructions stored on a media accessible by a computer and executable on said computer, wherein said computer program performs the steps of:

(a) receiving one or more player inputs representative of respective player moves;

(b) generating opponent signals with a chess engine kingbrain, said opponent signals representative of opponent chess moves, said kingbrain being characterized by a kingbrain rating which automatically adapts to the skill level of a player based on the player's moves in previous games in a multiple game match;

(c) establishing a kingbrain rating in response to one or more of the player moves;

(d) comparing one or more player moves with a player plan of expected player moves;

(e) generating one or more opponent moves according to a predetermined plan if said player moves do not deviate from said player plan;

(f) adapting one or more opponent moves based on player's ability if said player moves deviate from said player plan; and (g) simultaneously accessing a chess engine queen brain for generating opponent moves that are not based on the player's ability;

(h) wherein the kingbrain can be characterized by at least a heroic style characterized by high aggressiveness and a craven style characterzed by high defensiveness, the system including computer readable code means to cause the kingbrain to assume the heroic style when at least one of: the kingbrain and queen brain, determines that the player is losing, the system including code means to cause the kinqbrain to assume the craven style when at least one of: the kingbrain and queen brain, determines that the player is winning.

* * * * *